United States Patent [19]

Baker

[11] Patent Number: 5,001,648

[45] Date of Patent: Mar. 19, 1991

[54] METHOD AND APPARATUS FOR A MAIL PROCESSING SYSTEM

[75] Inventor: Christopher A. Baker, West Lafayette, Ind.

[73] Assignee: M.A.I.L. Code, Inc., Lafayette, Ind.

[21] Appl. No.: 514,193

[22] Filed: Apr. 25, 1990

Related U.S. Application Data

[63] Continuation of Ser. No. 422,952, Oct. 18, 1989, abandoned.

[51] Int. Cl.[5] ..... G07B 17/02

[52] U.S. Cl. ..... 364/464.03; 177/4; 177/25.15

[58] Field of Search ..... 177/4, 25.15; 364/464.02, 464.03, 466

[56] References Cited

U.S. PATENT DOCUMENTS

| | | | |
|---|---|---|---|
| 3,388,758 | 6/1968 | Allen et al. | 177/4 |
| 4,108,363 | 8/1978 | Susumu | 177/4 X |
| 4,319,328 | 3/1982 | Eggert | 364/466 |
| 4,366,552 | 12/1982 | Uchimura et al. | 177/25.15 X |
| 4,780,828 | 10/1988 | Whisker | 364/464.02 |
| 4,800,506 | 1/1989 | Axelrod et al. | 364/478 |
| 4,851,195 | 4/1989 | Baer et al. | 364/464.02 |
| 4,892,162 | 1/1990 | Dolan | 177/25.15 |
| 4,908,768 | 3/1990 | Gelfer et al. | 364/464.03 |

OTHER PUBLICATIONS

DIGI Electronic Platform Scales spec sheet for DS-410 and DS-420.

*Primary Examiner*—Parshotam S. Lall
*Assistant Examiner*—Edward R. Cosimano
*Attorney, Agent, or Firm*—Woodard, Emhardt, Naughton Moriarty & McNett

[57] ABSTRACT

Mail handling or processing systems are disclosed wherein the entire lot or batch of mail pieces is loaded into a bin for processing. Each mail piece is individually removed by an operator while the computer monitors the weight of the bin and simultaneously produces serial numbers for affixing to each mail piece. In an alternative embodiment a postage meter provides postage imprinting and labelling for each mail piece removed. By monitoring the tare weight difference of the bin prior to and after removal of each mail piece, the mail piece weight is determined from the difference between the two tare weights. The weight of each mail piece is required in order to determine postage cost or mail charges for each mail piece.

After all pieces of mail are removed from the bin, an operator can optionally key the system to produce a postal service form complying with manifest mailing requirements. The computer also produces a manifest including serial numbers and mail charges related to each serial number marked mail piece and a manifest summary.

In an alternate embodiment, the bin is loaded one by one with each mail piece while a computer simultaneously monitors the weight of the bin as each mail piece is added, serial numbers are produced for affixing to each mail piece, and the computer links each serial number with a weight deviation thereby calculating mail charges for each mail piece and storing the information for reproduction in summary form in a mailing manifest.

37 Claims, 9 Drawing Sheets

METHOD AND APPARATUS FOR A MAIL PROCESSING SYSTEM

REFERENCE TO RELATED APPLICATIONS

This application is a continuation-in-part of copending patent application Ser. No. 422,952 filed Oct. 18, 1989, now abandoned.

BACKGROUND OF THE INVENTION

This invention is generally related to mail processing equipment and more specifically to mail processing equipment which weighs and posts mail or produces a mail and/or parcel manifest for a plurality of weighed mail items.

Automated mail processing equipment which imprints postage costs on envelopes is relatively expensive equipment for purchase by small scale businesses. An inexpensive system which enables efficient posting of mail is needed for applications wherein an operator is available to assist in the processing of variable weight mail pieces.

The United States Postal Service Manifest Mailing System (MMS) permits the postal service to accept and verify mailings containing non-identical weight and/or rate pieces of the same mail class and processing category. The MMS is designed for situations in which postage charges for non-identical mail pieces cannot be adequately verified by weighing, hence normal acceptance procedures are impractical. Generally speaking, the MMS provides a system by which a postage patron can establish a relationship with the United States Postal Service for handling large quantities of mail in a most efficient manner. Other mail or parcel companies, such as United Parcel Service or Federal Express, or the like, can use comparable systems.

A typical manifest mail handling system includes a computer for controlling various pieces of equipment, a weighing device for weighing mail pieces, and assorted mail handling equipment for moving mail items in and out of a weighing station. A typical mail handling procedure involves the following steps for a manifest mail handling system: 1) marking a serial number on the mail piece; 2) weighing the mail piece; and 3) storing in computer memory the weight of the mail piece, the serial number or I.D. number affixed to the mail piece, and the postage required based upon the weight of the mail piece. This procedure is carried out for each mail piece in the lot. Once each piece has been weighed individually, a manifest is prepared by the computer system. The manifest includes the following information for each mail piece: mail piece I.D. or serial number, zone, weight, postage, and cumulative total postage. Additionally, a manifest summary page is created by the computer including the following information: zone, number of pieces per zone, weight, and postage paid. Further, a statement of mailing is prepared by the computer which summarizes the results of the mail piece weighing and categorization process. Examples of such mailing statements are Form 3605 and Form 3602 as specified by the United States Postal Service for permit mailing purposes.

A significant drawback exists with respect to mail weighing systems of the prior art and the system described above relating to the individual weighing of each mail piece. With respect to automatic weighing equipment, three periods of time expire for each piece of mail which is handled. These time periods are: loading time, stabilizing and weighing time, and unloading time. Elimination of one of these time components will result in a substantial savings in a mail processing system designed to post mail or a system designed to weigh mail pieces and produce a manifest of the weighed mail pieces.

An improved mail processing system which reduces or eliminates the loading or unloading time for all mail pieces in a processed lot of mail to be processed will substantially decrease the costs related to the posting of mail pieces or the processing of manifest mailings.

SUMMARY OF THE INVENTION

An apparatus and a method for more efficient mail processing systems is disclosed.

According to one aspect of the present invention, an apparatus for weighing mail pieces and imprinting postage thereon comprises means for weighing a plurality of mail pieces at one time, means for automatically detecting in connection with said means for weighing an initial stabilized weight state, a first subsequent stabilized weight state in response to a change in the number of mail pieces, and a second subsequent stabilized weight state in response to a further change in the number of mail pieces, first difference means for calculating in response to the occurrence of said first subsequent stabilized weight state a first weight value equal to the absolute difference between said initial and said first subsequent stabilized weight state and printing a postage label in response thereto, and second difference means for calculating in response to the occurrence of said second subsequent stabilized weight state a second weight value equal to the absolute difference between said first and said second subsequent stabilized weight state and printing a postage label in response thereto.

According to another aspect of the invention, an apparatus for weighing mail pieces and producing a weight manifest comprises means for weighing a plurality of mail pieces at one time, means for detecting in connection with said means for weighing an initial stabilized weight state, a first subsequent stabilized weight state in response to a change in the number of mail pieces, and a second subsequent stabilized weight state in response to a further change in the number of mail pieces, first difference means for calculating in response to the occurrence of said first subsequent stabilized weight state a first weight value equal to the absolute difference between said initial and said first subsequent stabilized weight state, second difference means for calculating in response to the occurrence of said second subsequent stabilized weight state a second weight value equal to the absolute difference between said first subsequent stabilized weight state and said second subsequent stabilized weight state, and means for producing a manifest including said first and second weight values.

One object of the invention is to provide improvements in and relating to an apparatus and method for a mail processing system.

Another object of the present invention is to improve efficiency in relation to mail processing systems and reduce the cost of mail preparation and delivery of mail pieces and parcels.

A further object of the present invention is to provide manifest mail processing capabilities in a more efficient manner to businesses which cannot afford highly automated mail processing equipment.

Related objects and advantages of the present invention will be apparent from the following description of the preferred embodiment.

DESCRIPTION OF THE PREFERRED EMBODIMENT

Figure 1:
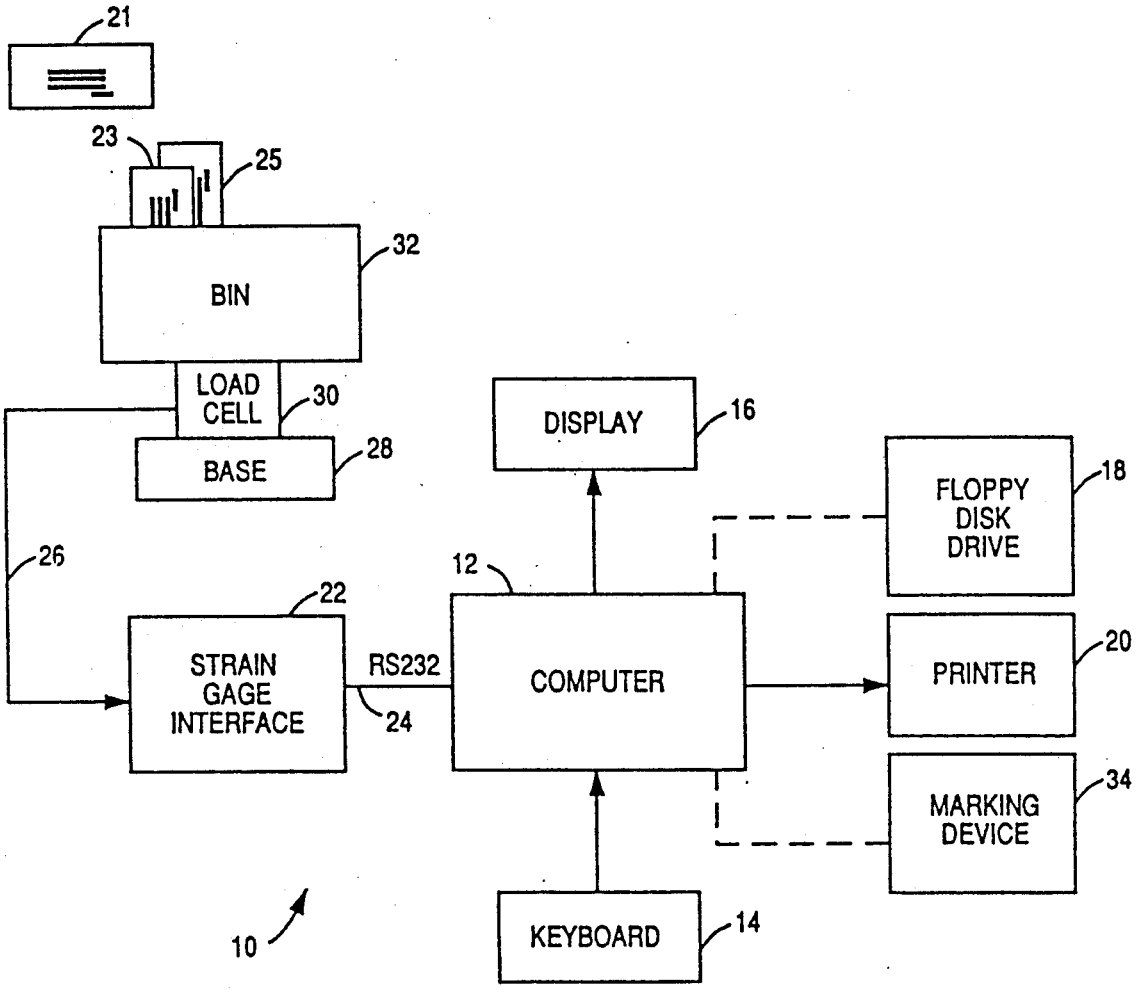
FIG. 1 is a block diagram illustrating the components of the manifest mail handling system according to the present invention attached thereto.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a block diagram for the manifest mail handling system 10 according to the present invention is shown. Computer 12 receives operator input from keyboard 14 and displays operator instructions via display 16. Computer 12 includes suitable amounts of I/O, ROM and RAM for execution of the software according to the present invention. Printer 20 is connected to computer 12 and provides a means for printing a manifest, or means for printing serialized labels. Strain gage interface 22 is connected to load cell or strain gage 30 by way of signal path 26. Load cell 30 is positioned between a base member or platform 28 and a mail bin 32. Load cell 30 provides an output signal in analog form which is proportional to the load or weight placed upon the load cell by the bin 32 and objects contained within bin 32. The analog output signal of the load cell 30 is supplied via signal path 26 to strain gage interface 22. Strain gage interface 22 includes an analog to convert digital (A/D) converter to the analog load cell output signal into a digital binary value compatible with most computer systems. The digital value representing the weight force on the load cell is supplied to computer 12 from strain gage interface 22 by way of an RS232c serial interface connection 24 well known in the art. Floppy disk drive 18 and marking device 34, both shown connected to computer 12 by broken lines thereby indicating an alternate embodiment feature, provide optional operational characteristics for the manifest mail handling system 10 as will be described below.

Operationally speaking all of the pieces of mail, mail pieces 21, 23 and 25, which are to be mailed are placed into bin 32. Bin 32 can be permanently or removeably attached to the load cell 30. Computer 12 is thereafter instructed to begin execution of a manifest mail handling program. The weight of bin 32 is determined when computer 12 sends a character via interface 24 to strain gage interface 22. Strain gage interface 22 responds with 16 bits of digital information (2 bytes) corresponding to the force present on load cell 30. The 16 bits of information or scale count include one sign bit and 15 bits of resolution. Computer 12 outputs several consecutive requests to strain gage interface 22 and receives a scale count or weight reading each time a character is output. This procedure is performed in order to determine whether or not the force on load cell 30 is stable. If several readings in sequence are relatively close to the same weight, computer 12 decides that the weight placed upon load cell 30 is stable, and instructs the operator audibly and visually to proceed to remove a mail piece by placing a message stating such on display 16 and causing an audio beep to occur. At this point, an operator will remove one of the mail pieces 21 from bin 32, while computer 12 continuously monitors the weight of bin 32 via strain gage interface 22 and load cell 30. If a variation in the weight of bin 32 occurs which indicates the removal of mail piece 21, i.e. a stable weight deviation in excess of a predetermined amount particularly a tenth of an ounce, computer 12 will make an entry in the memory of computer 12 for mail piece 21, assign a serial number to mail piece 21, record the weight deviation as the actual weight of mail piece 21, and calculate the postage accordingly based upon the weight and the class of mail currently being processed. This process continues for mail pieces 23 and 25 with computer 12 calculating a weight difference or deviation as each mail piece is removed from bin 32 thereby creating a new tare weight or new reference weight. Each weight deviation will correspond to the weight of the piece removed, and a corresponding postage cost will be calculated and stored in memory for each mail piece 21, 23 and 25.

In order to comply with the MMS requirements of the United States Postal Service, each mail piece must contain a serial number or I.D. number affixed to the front side of the envelope in one of three designated locations. The serial number can take the form of a number printed on the envelope by optional marking device 34. Such a device 34 is well known in the art and is computer controlled and connected by a broken line with computer 12. Upon removing mail piece 21 from bin 32, the operator places the mail piece in, under or near marking device 34 and a serial number is affixed to the front side of the piece 21 in one of the designated locations. Alternatively, marking device 34 may be a hand held imprinting device which can be placed adjacent to or on top of mail piece 21 and activated to imprint the serial number on the mail piece. An alternate technique for marking a serial number on the mail pieces is to use preprinted labels. Another alternative is to print labels with serial numbers and permit imprints using marking device 34 as each mail piece is weighed. An operator affixes each label to a corresponding envelope or mail piece just weighed. A further alternative is the use of envelopes with preprinted permit stamps and serial numbers.

Floppy or fixed disk drive 18, shown connected to computer 12 by a broken line, provides an optional device for electronically creating and storing a manifest according to another embodiment. Such an electronic manifest on a floppy disk or magnetic media is specified as acceptable in the publication 401-B dated May 1989 and entitled *Manifest Mailing System (MMS) First-Class* 1 to 11 *Ounces Mail* published by the United States Postal Service.

The display 16, computer 12 and keyboard 14 as well as the printer 20 and floppy disk drive 18 are standard off the shelf available hardware items and may be an IBM PC compatible computer system. The strain gage interfacing device is an SM232 model manufactured by International Computing Scale. The load cell or strain gage 30 is compatible with the SM232 device must be a 350 Ohm strain gage transducer. The SM232 device provides two bytes of binary data when activated by computer 12. Computer 12 outputs any ASCII character by way of communications link 24 to activate the strain gage interface 22. The strain gage interface 22 responds to the character received from the computer and outputs a two byte data word. Computer 12 receives the two bytes in the form of 15 bits of resolution information and a most significant sixteenth bit which is a sign bit. The sign bit indicates a positive strain or tensile loading, and a negative sign indicates compressive forces present on load cell 30. A simple conversion routine is then executed by the software in computer 12 to convert the two bytes of information into an actual weight in the form of ounces or tenths of an ounce. Such a conversion routine is well known in the art and need not be described in detail here.

The load cell 30 and interface 22 are calibrated prior to the weighing of mail pieces in order to ensure accurate weighting results. Such a calibration procedure involves setting switches within the SM232 device in accordance with a known calibration procedure supplied with the SM232 device. The SM232 board consists of a load cell power supply, signal conditioning circuitry, an analog-to-digital converter (A/D) and a UART, a Universal Asynchronous Receiver Transmitter device well known in RS232 communications applications. Baud rate, number of stop bits, parity, and seven versus eight bit word length are all configurable in the SM232 device. The computer is also configured so its serial interface functions similarly.

Figure 2:
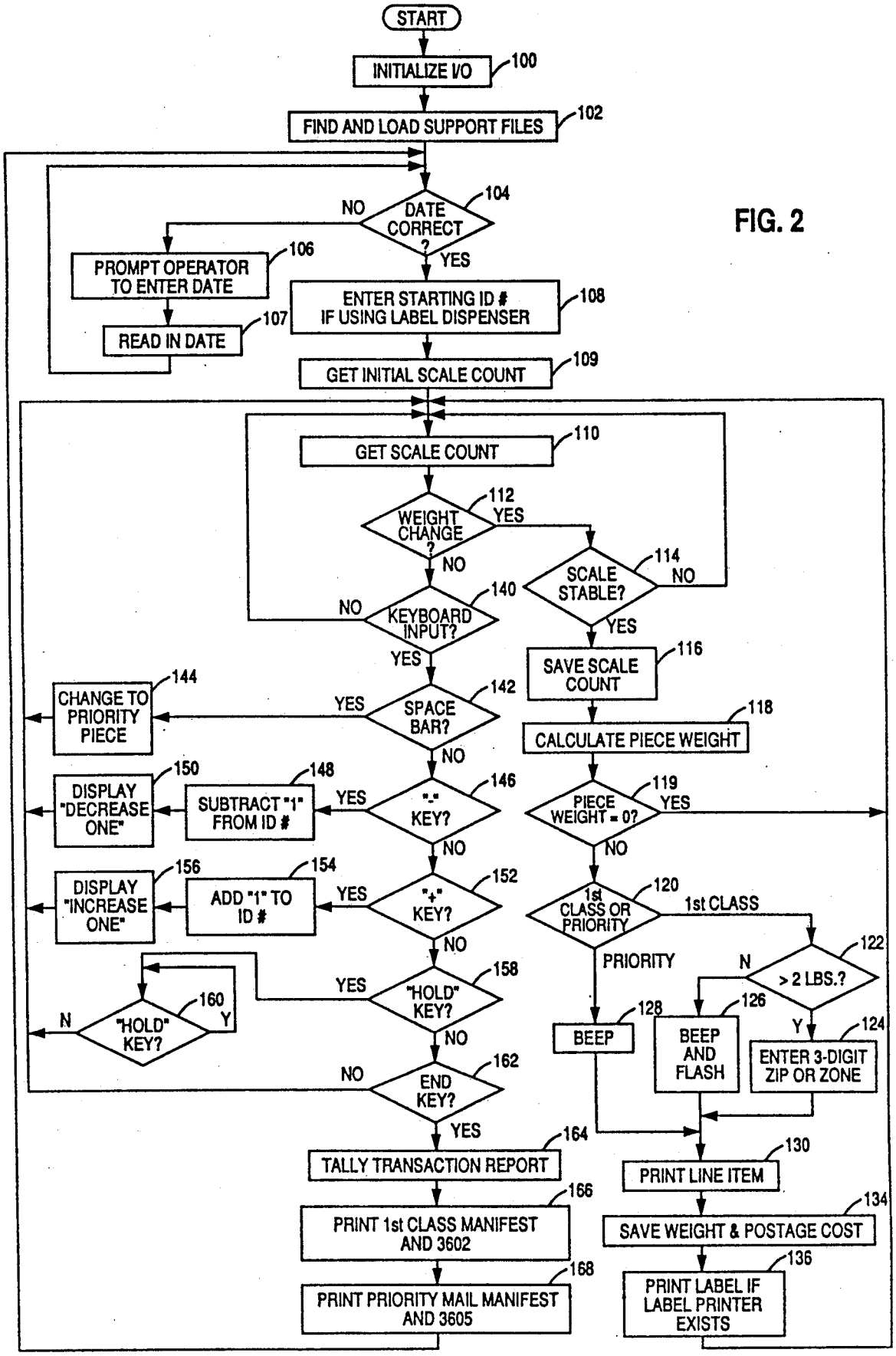
FIG. 2 is a main level flowchart for the computer program of the manifest mail handling system.

Referring now to FIG. 2, a flowchart for the manifest mail handling system according to the present invention is shown. At step 100, the computer will initialize all I/O and communications interfaces. Subsequently at step 102, any support data files necessary for execution of the system software are located and loaded into memory from mass storage devices. If the support files are not available, the program will abort and end. Optionally, at step 104 the computer determines whether the electronic date is correct by displaying the date on display 16 and requesting confirmation from the operator. If the date is not correct, program execution continues at step 106 where the operator is prompted to enter the correct date and the operator enters such at step 107. After the correct date is entered at step 107, again the program will display a prompt on display 16 requesting the operator to verify the correctness of the date. If the date is verified as correct via an input from keyboard 14 at step 104, program execution will continue at step 108. At step 108, the computer prompts the user via display 16 to enter a starting serial number or I.D. number via keyboard 14. The serial number will correspond to the first number in a sequence of numbers printed by a label printer, such as marking device 34.

An initial stabilized scale count or stable weight reading is obtained by the computer at step 109. The initial stable scale count is then saved as the tare count in memory. A subsequent scale count is then obtained at step 110. At step 112, the scale count obtained in step 110 is compared to the tare count from step 109. If a weight change is detected at step 112, i.e., the scale count is different from the tare count by 2 or more, then program execution continues at step 114. If the weight difference, or scale count versus tare count is less than 2, the computer will continue with step 140 and check for an input from the keyboard. If no key has been pressed, program execution will continue at step 110. If a key has been pressed by an operator, then program execution will continue at step 142 wherein various characters entered at keyboard 14 will result in activation of various functions based upon the key depressed.

If a space character is detected at step 142, the computer will change postage rates calculated to priority piece mail and return to step 110. If a space character is not detected at step 142, program execution continues with step 146 where the computer checks to see if the keyboard input is a minus character, indicating the minus key has been depressed by the operator. If true, the computer will subtract one from the I.D. number stored at step 148. Thereafter, at step 150 the computer will output to the printer "Decrease 1". Thereafter, program execution will return to step 110.

If at step 146, the character is not a minus character, program execution will continue with step 152 where the program checks to see if the character entered at the keyboard is a plus character. If at step 152 the computer determines that the character entered at the keyboard is not a plus character, then program execution continues at step 158. If true, program execution will continue at step 154 and the program will add one to the I.D. number and at step 156 output to the printer the message "Increase One". After step 156, program execution continues at step 110.

If the character detected from the keyboard is a hold key at step 158, then program execution will hang in an endless loop at step 160 until a subsequent character is detected which is not a hold character. If the hold character is not detected, i.e. a key other than the hold key has been depressed, then at step 160 program execution will continue with step 110. If at step 158 a hold key is not detected from the keyboard, program execution will continue at step 162 where the computer will test whether the end key has been depressed as signified by a specific character corresponding to a request to end processing. When an end processing request is received at step 162, program execution continues with step 164 where a transaction report is tallied. Thereafter the first class manifest is printed at printer 20 at step 166 and form 3602 (specified by the postal service) is also printed. After step 166, program execution continues at step 168 where a priority mail manifest is printed and form 3605 (Postal Service form) is printed at printer 20. After step 168, the program execution returns to step 104. If at step 162 an end key is not detected, program execution will continue with step 110.

Returning to step 112, if a weight change has been detected by a variance in the weight reading or scale count, then program execution continues at step 114 where the scale count is input several times to determine whether the scale is stable. If the scale is not stable, as determined by monitoring deviations in the scale count readings, then program execution continues at step 110. If the scale is stable, i.e. several consecutive scale counts are within a predetermined window (plus or minus 1 or 2 counts), then program execution continues at step 116 where the scale count is again input and saved for stability. Thereafter at step 118, the piece weight of the mail piece is calculated. If the piece weight (scale count minus tare count) is zero at step 119, then the computer returns to step 110 since no weight change has occurred to justify a manifest entry and postage calculation. Else, if the piece weight is not zero, execution continues at step 120. At step 120 the computer determines whether the mail piece is a First-Class or Priority mail piece by testing to see if the converted scale count (in ounces) or piece weight is in excess of eleven ounces. If the mail piece weighs eleven ounces or less, program execution continues at step 128 where the computer will output a character to the keyboard to cause an audible beep. Following the audible beep, a line item is printed at step 130. If at step 120 the mail piece is determined to weigh more than eleven ounces, then it is thus a Priority mail piece, and execution continues at step 122 where the weight calculated is tested against a two pound limit. If the piece weight is greater than two pounds, than a 3-digit zip or zone code must be entered by the operator to appear on the manifest. The zip code information is entered at the keyboard by the operator at step 124 in response to a prompt on the display so that it can be printed with the serial number. After step 124 program execution continues at step 130. If the Priority mail is less than two pounds, then the computer will output a beep character to the keyboard and flash a signal on the display 16 at step 126. After step 126, execution continues with step 130 where a line item is printed. Following step 130, at step 134, the information regarding the mail piece, the weight, zip code, and the serial number corresponding to the weight is saved for later use in printing the manifest. At step 136, if a label printer exists, a stick-on label is printed with the serial number. The label may also have the zip or zone code printed thereon if the mail piece was determined to be Priority mail at step 120 and in excess of two pounds at step 122. Following step 136, program execution returns to step 110 to begin the process of monitoring weight via the output of the load cell and the strain gage interface 22 for another weight change indicating another mail piece has been removed from weight bin 32 thereby initiating the steps through step 112, step 114, step 116, etc. to process another mail piece.

Figure 3:
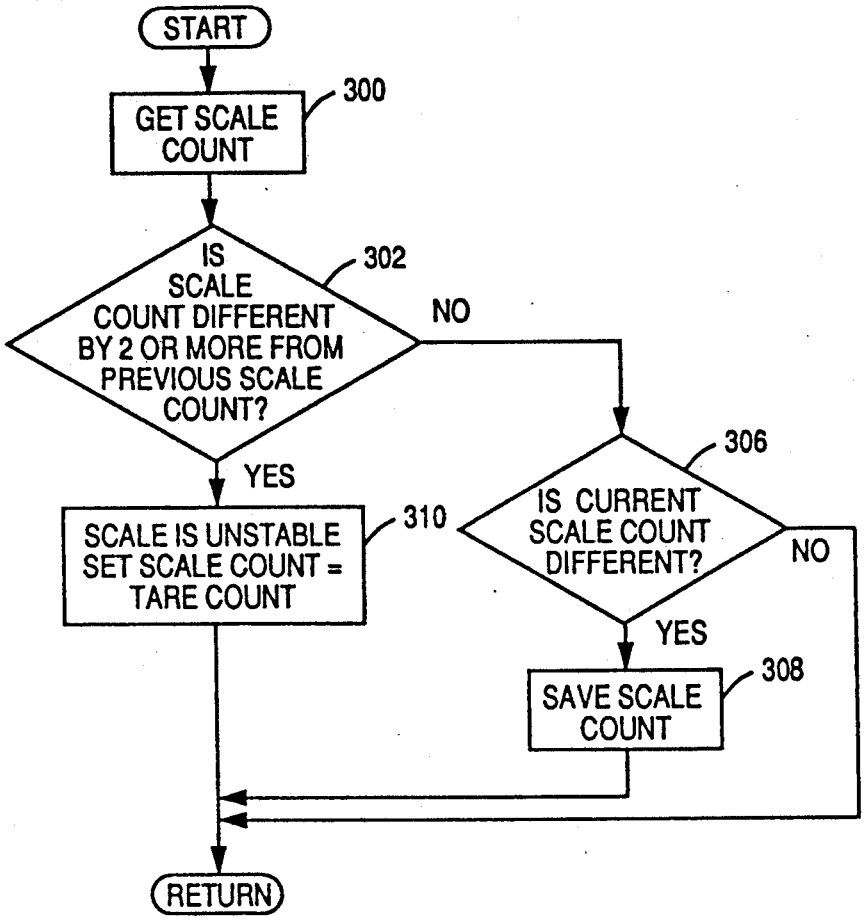
FIG. 3 is a flowchart for the "Save Scale Count" step 116 of the flowchart of FIG. 2

Referring now to FIG. 3, a more detailed flowchart for step 114 of the flowchart of FIG. 2 is shown. At step 300 an additional scale count is obtained by computer 12. At step 302, the computer compares the scale count or weight reading obtained at step 300 with the scale count obtained in step 110 of FIG. 2. At step 302, the scale counts from steps 110 and 300 are compared. If the count or magnitude difference is two or more, program execution continues at step 310 where the scale count is set equal to the tare count and program execution returns to step 116. If, at step 302, the count difference is less than two, then at step 306 the computer determines whether the current scale count is different from the previous scale count obtained at step 110. If the scale count from step 300 is different, then it is saved as the new scale count at step 308. Program execution continues with step 116 after step 308. If no difference is calculated at step 306, then program execution returns to the calling routine.

Figure 4:
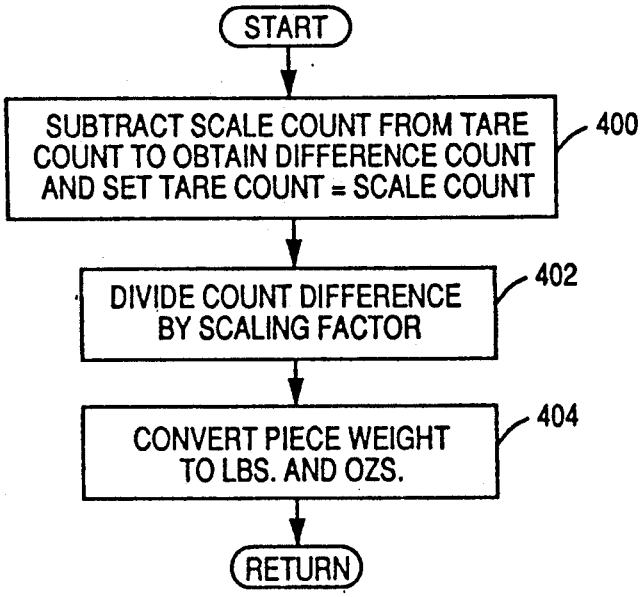
FIG. 4 is a flowchart for the "Calculate Piece Weight" step 118 of the flowchart of FIG. 2.

Referring now to FIG. 4, a flowchart for step 118 of FIG. 2, Calculate Piece Weight, is shown in more detail. At step 400, the computer subtracts the scale count saved at step 308 from the previously saved tare count from previous execution of step 400, and then saves the scale count as the new tare count. At step 402, the count difference is divided by a scaling factor to determine actual weight in ounces. Subsequently, at step 404, the value calculated in step 402 is converted into pounds and ounces and stored in a memory location. Program execution thereafter returns to the calling routine.

The unique operation of the program according to the present invention provides the operator with the ability to either load the bin piece by piece with mail to be processed for the MMS. Alternatively, the mail may all be loaded into bin 32 and each piece removed one by one to weigh each piece and produce the manifest necessary for MMS. Either technique, the unloading of the bin or the loading of the bin piece by piece, both result in the same time savings in that the time delay for stabilization of the scale is minimized and a unique process for producing the manifest necessary for manifest mailing system requirements is achieved.

Attached to the end of the specification is a program listing of a program executable on an IBM compatible computer. The program listing corresponds to the flowcharts disclosed in FIGS. 2–4 and is included to further describe the operation of the system 10 according to the present invention.

Figure 5:
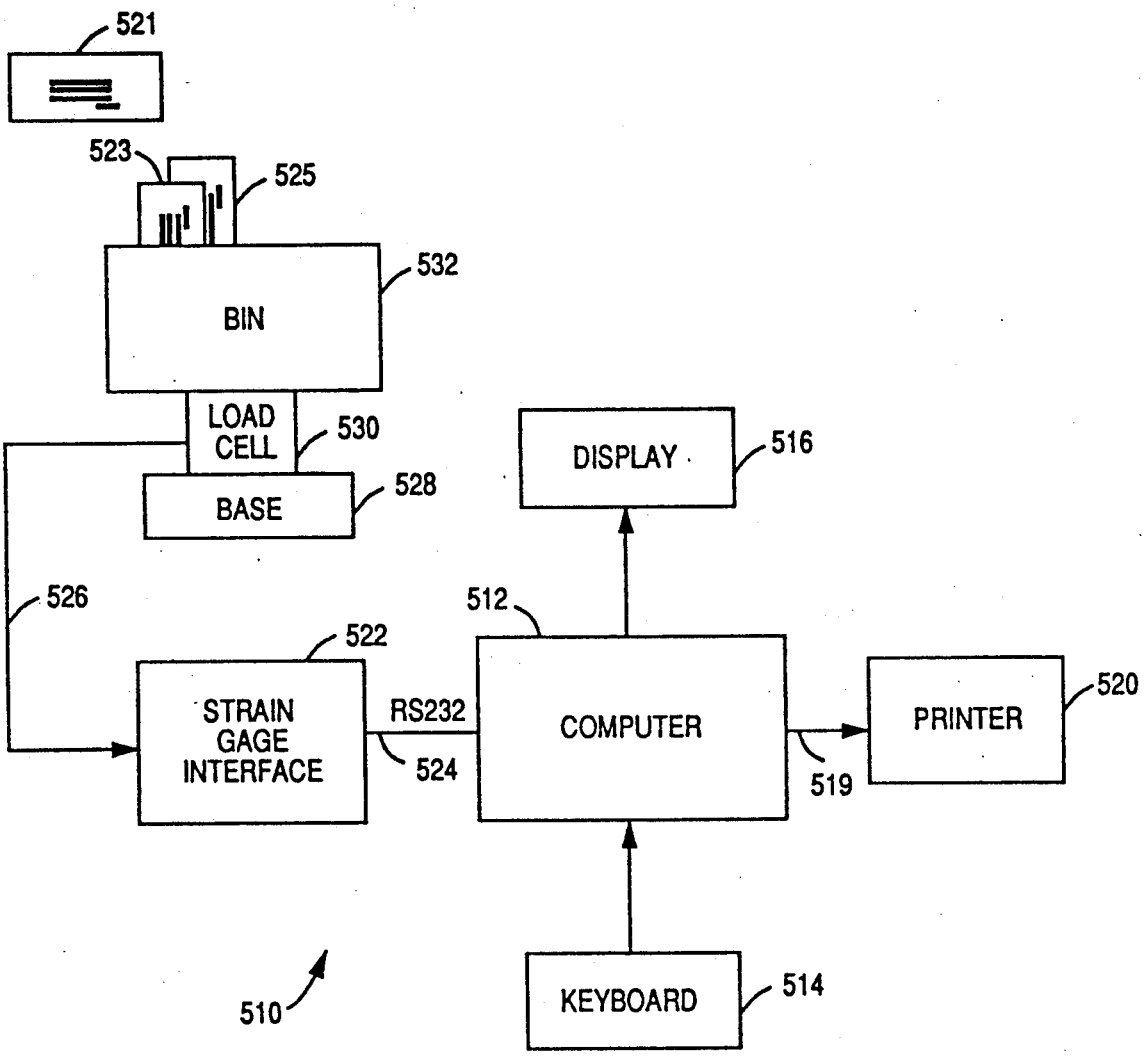
FIG. 5 is a block diagram illustrating the components of another embodiment of a mail handling system according to the present invention.

Referring now to FIG. 5, a block diagram for another mail handling system 510 according to the present invention is shown. The component parts of the system 510 are identical with those of the system 10 shown in FIG. 1 with the postage meter 520 replacing the printer 20 of FIG. 1. Thus, instead of printing serialized labels or manifests as in the embodiment of FIG. 1, postage meter 520 is used to print postage labels or imprint envelopes removed from bin 532 in the operation of the system 510 according to the present invention.

System 510 is comprised of a bin 532 containing envelopes 521, 523 and 525, a load cell 530 upon which bin 532 rests, a base 528 which supports load cell 530, a signal path 526 for interfacing between load cell 530 and strain gage interface 522, a serial data interface 524 corresponding to a standard RS232c interface, a computer 512 which accepts inputs from keyboard 514 and provides feedback in the form of informative displays and data on display 516, and postage meter 520 which is connected to computer 512 via interface 519. Interface 519 provides a compatible electrical communication interface between computer 512 and meter 520. Bin 532 can be permanently or removeably attached to the load cell 530.

Operationally speaking, the system 510 functions nearly identically to the system 10 of FIG. 1 with the exception of the computer 512 supplying a command string via interface 519 to meter 520 for each successive stable weight state corresponding to a piece of mail removed from bin 532. Thus, a postage label providing the appropriate amount of postage or an imprint operation, wherein mail such as envelope 521 is located beneath an imprinting station of meter 520, provides the means for marking envelope 521 with the appropriate postage cost based upon weight of the envelope 521.

A step-by-step operation of the system involves loading an assortment of envelopes or pieces of mail to be posted into bin 532. Such envelopes or pieces of mail are represented by envelopes 521, 523 and 525. As an object is removed from the bin 532, such as envelope 521, the forces present on load cell 530 change by an amount equal to the weight of envelope 521. A weight or force signal is monitored, via signal path 526 connecting strain gage interface 522 with load cell 530. Strain gage interface 522 responds to commands from computer 512 to monitor the signal present on signal path 526. Thus, when computer 512 requests strain gage interface 522 to analyze the signal present on signal path 526, strain gage interface 522 responds with 16 bits or 2 bytes of information corresponding to the force signal produced by load cell 530 which corresponds to the weight or forces acting on load cell 530. When computer 512 is in a state of operation of continuously monitoring the forces on load cell 530, and a deviation in the weight of the objects in bin 532 is detected by way of a change in the signal present on signal path 526, computer 512 will take additional readings from strain gage interface 522 to determine whether or not the weight or force on load cell 530 has stabilized. If so, computer 512 concludes that an envelope or object has been removed from bin 532. Computer 512 then determines the difference between the weight or force reading stored for the previous stable weight state of the load or force present on load cell 530 and the new detected stable weight state for the current output of load cell 530 and computes a weight difference value.

Information regarding the class of mail processed, initially entered by an operator through keyboard 514, provides computer 512 with guidance as to the amount of postage necessary for the object removed from bin 532. Computer 512 then accesses tables of information stored in memory which provide the appropriate postage cost information based on class of mail and priority mail determinations in order to electronically command postage meter 520 to print an appropriate label or imprint for the weight of envelope 521. Each subsequent envelope removed from bin 532 is processed for postage cost in accordance with the previously described sequence of events, wherein the system determines a new tare weight and calculates a difference value for each successive stable weight state. Each difference value, calculated from the immediately preceding stable weight state and the current stable weight state, corresponds to the weight of a mail piece removed from bin 532.

Postage meter 520 includes two devices in the preferred embodiment. A DATA-PAC Model No. MPC-100 Meter Communications Device provides a user friendly interface between a serial communication port of computer 512 and postage meter 520. The DATA-PAC device is available from DATA-PAC Mailing Systems Corp., 247 North Goodman St., Rochester, N.Y. 14607. The DATA-PAC device enables convenient electronic interfacing between computer 512 and postage meter 520. Postage Meter 520 is preferably a Pitney Bowes 6500 series postage meter. Any postage meter including remote control of cost or postage settings and capable of producing a mail imprint in response to electronic signals may be substituted for the DATA-PAC/Pitney Bowes 6500 combination disclosed herein.

Figure 6:
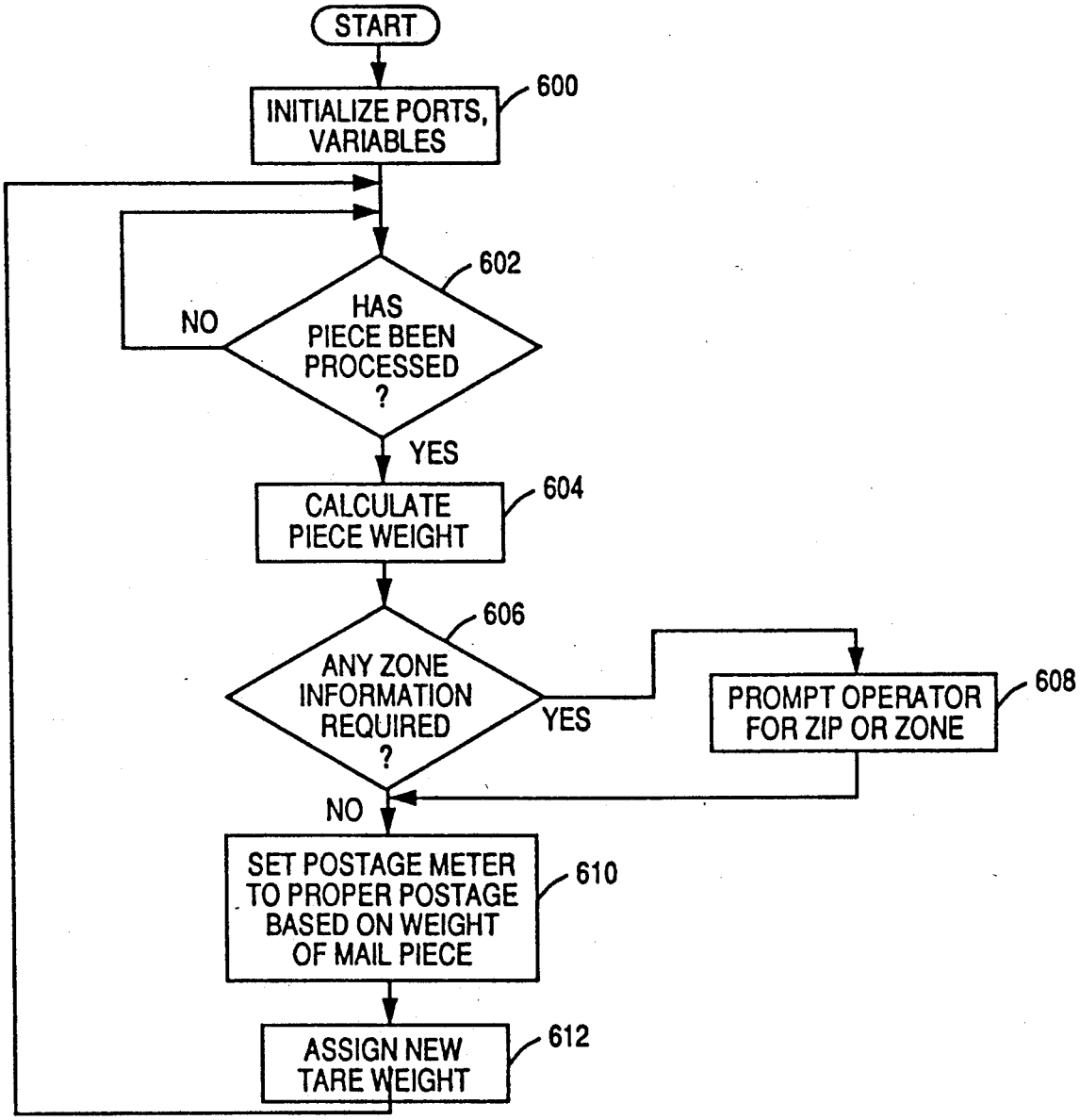
FIG. 6 is a main level flowchart for the software executed by the computer of FIG. 5.

Referring now to FIG. 6, a flowchart for the main control loop of the computer program executed by the mail weighing system 510 according to the present invention is shown. Communication ports and program variables are initialized at step 600. In addition, flags and other program variables are initialized at step 600 so as to ensure proper functioning of the software. At step 602, computer 512 examines the value of a software flag which indicates whether a mail piece has been processed or not processed. If at step 602 the software flag indicates that no mail piece has been processed, then program execution loops on itself at step 602 until the software flag indicates a piece has been processed. If, according to the software flag, a mail piece has been processed, program execution continues at step 604 where the computer calculates the piece weight of the mail piece removed from bin 532 by determining the absolute value of the difference between an initial bin tare weight determined in step 600 and a subsequent bin tare weight determined at step 602. The absolute value of the difference of these two weights is calculated at step 604.

If the difference value or piece weight calculated in step 604 exceeds certain predetermined weight values which result in the mail piece being categorized into a different mail rate class, a decision block 606 is encountered wherein the computer determines whether any zone information is required based upon the weight of the mail piece. If zone information is required, program execution will continue at step 608 where the user will be prompted to enter zip or zone information via the keyboard 514. After the user enters zip or zone information at step 608, program execution continues at step 610. If zone information is not required, program execution will continue at step 610 following step 606.

Postage meter 520 is programmed at step 610 to imprint the envelope or a mailing label with the proper postage based upon the weight of the mail piece determined in step 604. At step 612, a new tare weight is assigned to the bin 532 at step 612. This new tare weight reflects the weight of the bin and any envelopes or mail pieces which remain in the bin at that time. Subsequently, program execution returns to step 602 where the computer 512 continuously monitors the weight of the bin 532 to determine whether a subsequent mail piece has been removed from the bin. The computer software described in the flowchart of FIG. 6 is a means for automatically detecting a first and subsequent stabilized weight states when mail pieces are removed from the bin 532. The means for detecting then supplies a postage cost signal to the postage meter for each detected stable weight state which occurs after the first initial stable weight state is determined.

Figure 7:
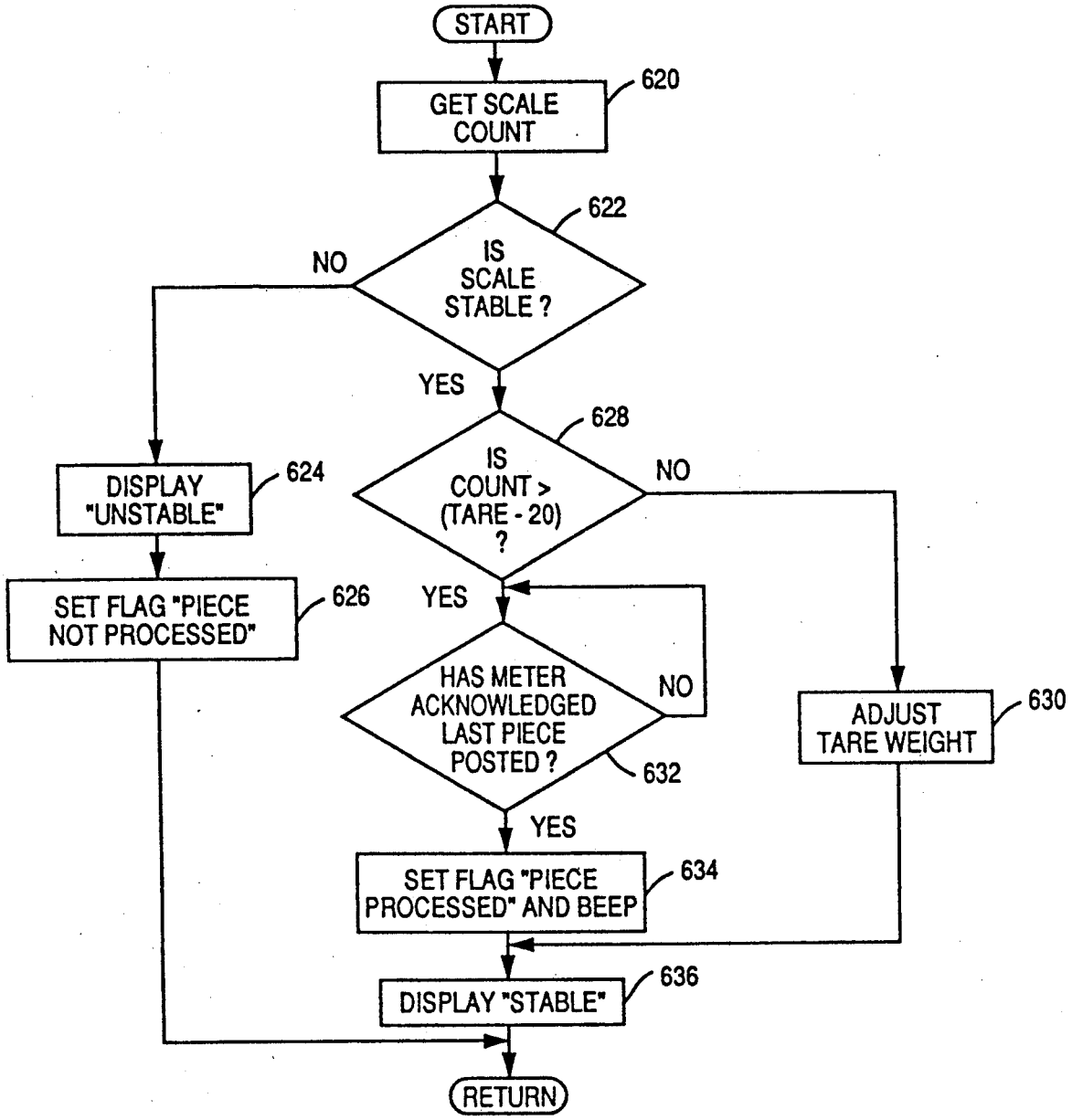
FIG. 7 is a flowchart providing further detail regarding step 602 of FIG. 6.

Referring now to FIG. 7, a flowchart which provides additional detail of step 602 of FIG. 6 is shown. The flowchart of FIG. 7 provides a detailed program flow description for block 602 of FIG. 6 wherein it is determined whether a mail piece has been processed. At step 620, computer 512 obtains a current scale count from strain gage interface 522 by electronically requesting such via the interface 524. In step 622, it is determined whether or not the scale is stable based upon multiple scale count readings obtained in step 620. If the scale is not stable at step 622, program execution will continue at step 624 wherein the computer 512 displays the message "unstable" on display 516. Subsequently, a flag is set which indicates that a mail piece has not been processed at step 626. Program execution then returns to step 604 of FIG. 6.

If at step 620 a flag is set indicating interface 522 is responding with stable scale count values, computer 512 will make a determination at step 622 that the scale is stable and program execution continues at step 628 where the decision block is encountered which tests the current scale count versus the quantity (tare-20). If the current scale count is not greater than the quantity (tare-20), the tare is adjusted at step 630 to the current scale count, and the message "stable" is displayed at step 636. Thereafter, program execution returns to the calling routine. If at step 628 the scale count, or most recently obtained reading of the bin weight, is less than the quantity (tare-20), indicating that a piece of mail has been removed from the bin, then computer 512 determines whether the postage meter 520 has acknowledged imprinting the last mail piece. If the last mail piece has not been imprinted, i.e. the postage meter has not cycled, then program execution loops on decision block 632 until the meter acknowledgment is received. After the meter acknowledgment is received, program execution continues at step 634 wherein a flag is set indicating that a mail piece has been processed, and an audible beep is produced by computer 512 to prompt the operator to resume processing mail pieces. Subsequently, after step 634 the message "stable" is presented on display 516 and program execution returns to the calling routine.

Figure 8:
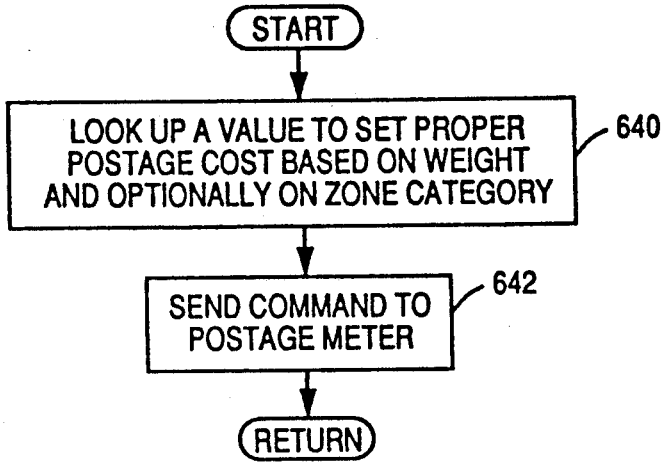
FIG. 8 is a flowchart providing further detail regarding step 610 of FIG. 6.

Referring now to FIG. 8, a more detailed flowchart for step 610 of FIG. 6 is shown describing how the postage meter is set or programmed to the proper postage based upon the weight of the mail piece. At step 640, computer 512 looks up a value in a predetermined table which provides information regarding the proper postage cost to be imprinted on the most recently processed mail piece. The postage cost is based upon the weight of the mail piece determined in step 604 of FIG. 6. Optionally, at step 640, zone information from step 608 of FIG. 6 is incorporated into the decision process of computer 512 in determining proper postage cost. Thereafter, at step 642, computer 512 outputs a command string, or series of bytes, to the DATA-PAC postage meter interface device. The following table provides information describing the component parts of the "SET METER" message sent to the postage meter via the meter interface device by computer 512 to prepare the postage meter for imprinting postage cost on an envelope or label.

Various techniques may be implemented to activate the meter 520 to imprint. One such technique includes placing the envelope to be imprinted onto a conveyor positioned to supply envelopes to an imprinting zone or area associated with meter 520. When the envelope arrives at the imprinting area, a sensor detects the presence of the envelope and the meter 20 is cycled to imprint postage costs on the envelope. Optionally, for larger mail pieces, the operator is provided with a hand or foot activated switch for tripping the meter 520 thereby causing a postage label to be imprinted.

TABLE I

| SET METER | | |
|---|---|---|
| Data | | Description |
| Byte 1: | SOH | Hex 01 |
| Byte 2: | 'S' | ASCII message type |
| Byte 3: | '0–9' | ASCII cents/10 |

TABLE I-continued

| SET METER | | |
|---|---|---|
| Data | | Description |
| Byte 4: | '0–9' | ASCII cents |
| Byte 5: | '0–9' | ASCII cents*10 |
| Byte 6: | '0–9' | ASCII dollars |
| Byte 7: | '0–9' | ASCII dollars*10 |
| Byte 8: | '0–9' | ASCII dollars*100 |
| Byte 9: | EOT | Hex 04 |
| Byte 10: | '0–9,A–F' | ASCII checksum lsd |
| Byte 11: | '0–9,A–F' | ASCII checksum msd |

Figure 9:
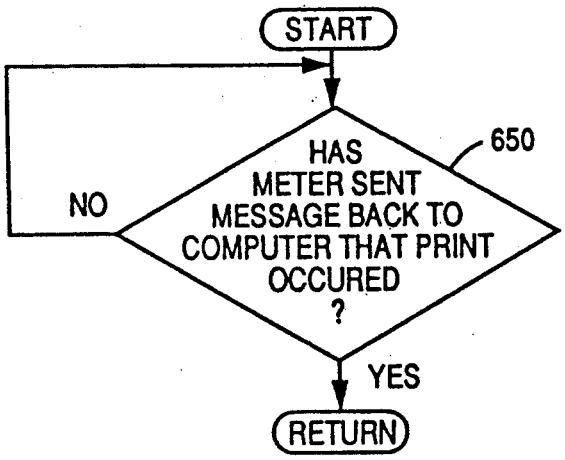
FIG. 9 is a flowchart providing further detail regarding step 632 of FIG. 7.

Referring now to FIG. 9, additional details are provided regarding step 632 of FIG. 7 in determining if the postage meter has acknowledged whether the last mail piece has been posted, or imprinted, with the correct postage. At step 650 of FIG. 9, computer 512 continuously monitors a serial communications port input buffer to determine whether or not a message byte has been received over the postage meter interface 519 from the postage meter (or interface device). Until a status message is received indicating the meter 520 is ready to imprint another mail piece, program execution loops on itself at step 650. Once the status message has been received indicating that an imprint has occurred, program execution returns to the calling routine. (Program execution continues at step 634 of FIG. 7.)

Figure 10:
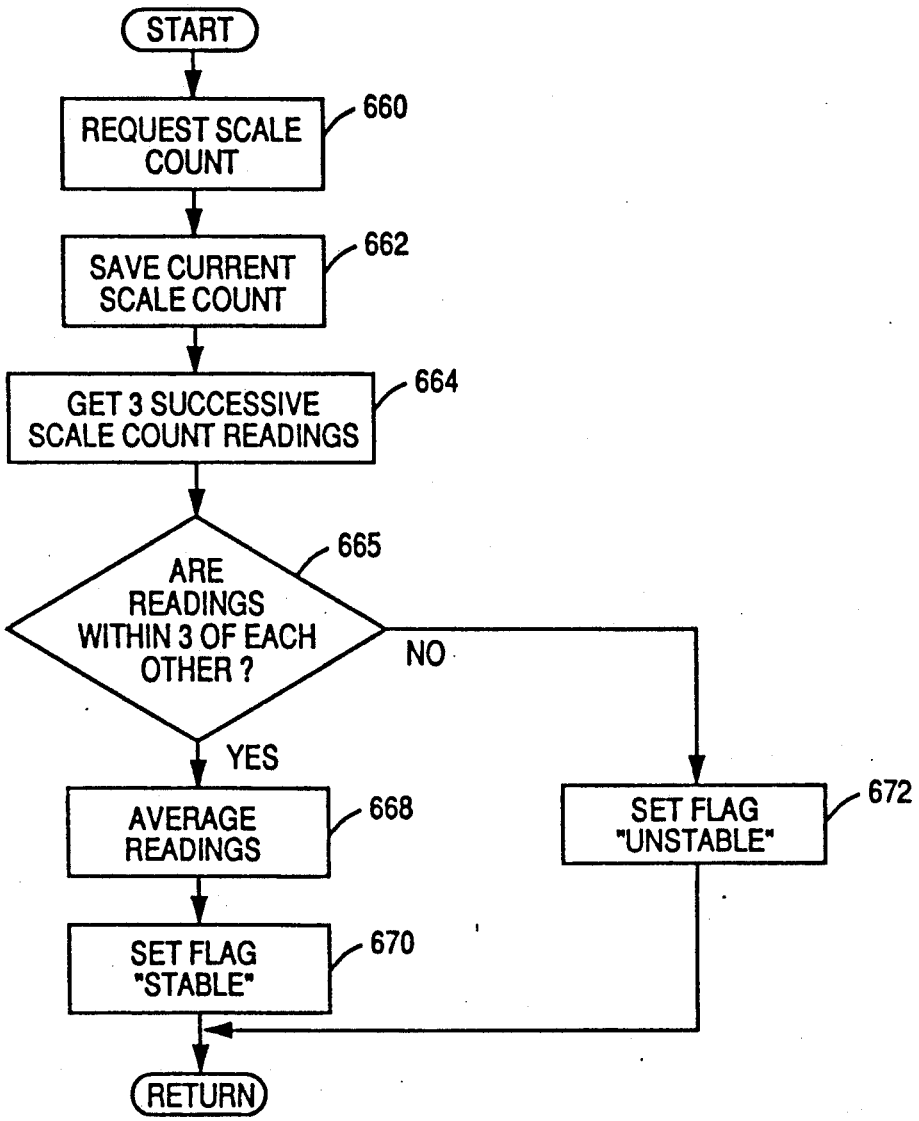
FIG. 10 is a flowchart providing further detail regarding step 620 of FIG. 7.

Referring now to FIG. 10, a more detailed description of the program steps executed at step 620 of FIG. 7 is shown for determining the current scale count corresponding to the weight of the bin 532 and the mail pieces presently contained therein. At step 660 computer 512 transmits an electronic signal to strain gage interface 522 via serial communications link 524. The serial communications link 524 is typically an RS232c standard interface. Strain gage interface 522 responds with a two byte value indicative of the load cell 530 output signal. The two byte value is saved at step 662. Three successive scale count readings are next obtained at step 664 from the strain gage interface 522. At step 665, computer 512 determines whether the three scale count readings obtained at step 664 are within three of one another. If so, program execution continues at step 668 where the three readings are averaged to produce a mean scale count value. Thereafter, at step 670, a software flag is set indicating that the scale counts or weight readings are currently stable. Program execution thereafter returns, after step 670, to the calling routine. If the three readings tested at step 665 are not within three of each other, program execution continues at step 672 where a software flag is set indicating that the scale is currently unstable. After step 672, program execution returns to the calling routine.

Figure 11:
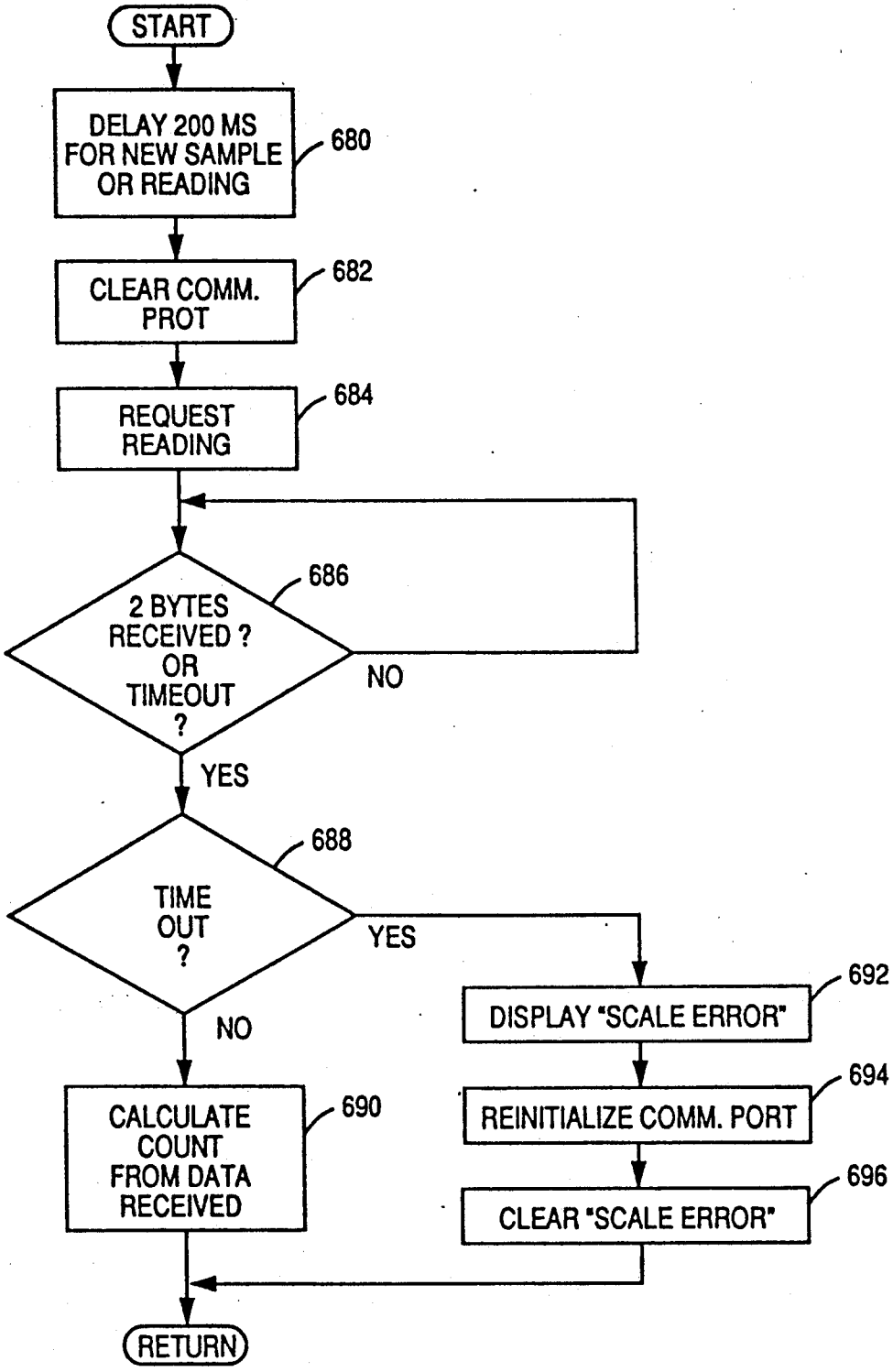
FIG. 11 is a flowchart providing further detail for step 664 of FIG. 10.

Referring now to FIG. 11, a more detailed software flowchart for step 664 of FIG. 10 is shown wherein three successive scale count readings are obtained by computer 512 from strain gage interface 522. At step 680, a two hundred millisecond delay occurs to provide a time delay between sampling the weight of the bin and its contents. At step 682, the computer clears the input of the communication port electronics connected to interface 524. At step 684, computer 512 transmits a message to strain gage interface 522 requesting a current scale count reading. At step 686, computer 512 monitors interface 524 for data originating from strain gage interface 522 which is destined for computer 512. If two bytes are not received at step 686, program execution will continue in a loop at step 686 until either two

```
 1  /*********************************************************
 2
 3  Source listing for "THE CHAMP".  Files printed below are:
 4
 5                 champ01.c
 6                 gwt.c
 7                 priority.c
 8
 9  Written by Christopher A. Baker, M.A.I.L.code Inc.
10
11
12
13                      "THE CHAMP", Version 1.0
14                  (c) M.A.I.L.code Inc., 1989
15                      ALL RIGHTS RESERVED
16
17
18
19                  *****  PROPRIETARY SOFTWARE *****
20
21        THIS SOFTWARE IS THE CONFIDENTIAL PROPERTY OF M.A.I.L.CODE
22        INC.  IT MAY NOT BE DISCLOSED, USED REPRODUCED, DISTRIBUTED,
23        REPRODUCED, MODIFIED OR DISPLAYED IN WHOLE, OR IN PART,
24        WITHOUT THE EXPRESS WRITTEN AGGREEMENT OF M.A.I.L.CODE INC.
25        MISAPPROPRIATION OF THIS SOFTWARE SHALL BE PROSECTUED TO
26        THE FILLEST EXTENT OF THE LAW.
27
28
29
30  (Printed 10/16/89 by CAB)
31  *********************************************************/
32
33
34  #include <stdio.h>
35  #include <bios.h>
36  #include <stdlib.h>
37  #include <graph.h>
38  #include <dos.h>
39  #include <malloc.h>
40
41  #define COM_NUM 1      /* 1 */
42
43  #define COM_NUM2 0
44
45  char far *buffer[10];
46  char cc_buffer[10];
47  char last_label = 0;  /* 0 for 1st class, 1 for Priority Mail */
48  FILE *stream;
49  FILE *stream1;
50  FILE *stream2;
51
52  unsigned int lbs,lbsav,tare,lbfinal;
53  char stable;
54  float lbs1,lbs2,lbs3,ozfinal;
55  char zone=0,ptype=0;      /* zone and piece type */
```

```
Line#  Source Line                                                    Microsoft C Compiler Version 5.10

  56
  57  char m[20];
  58  float total_post=0;
  59  float total_oz_lc=0,total_oz_pm=0;
  60  unsigned int total_lc=0,total_pm,total_lb_lc=0,total_lb_pm=0;
  61
  62  extern char zip[1000];
  63  extern int zc[6][71];
  64
  65  char l_clear[] = {90,83,13};
  66
  67  char l_d1[] = {80,87,66,48,48,49,48,48,51,48,48,48,49,57,53,48,13,
  68                 80,87,66,48,48,49,48,48,51,48,49,48,48,55,48,48,13,
  69                 80,87,66,48,48,49,48,49,48,48,48,48,49,57,54,48,13,
  70                 80,87,66,48,50,48,53,48,51,48,49,48,48,55,48,48,13,
  71                 80,87,65,48,48,53,53,48,56,51,49,48,48,48,70,73,82,83,84,32,67,76,65,83,83,32,77,65,73,76,126,48,13,
  72                 80,87,65,48,48,52,54,48,54,55,49,48,48,48,85,83,32,80,79,83,84,65,71,69,32,80,65,73,68,126,48,13,
  73                 80,87,65,48,48,52,48,48,53,49,49,48,48,48,73,78,68,73,65,78,65,80,79,76,73,83,44,32,73,78,126,48,13,
  74                 80,87,65,48,48,52,53,48,51,52,49,48,48,48,80,69,82,77,73,84,32,78,79,46,32,35,55,51,55,52,126,48,13};
  75
  76                    /*  Z  W  0  4  2  0  1  3  1  4  2  0  1  2  0  */
  77  char l_d2[] =        {90,87,48,52,50,48,56,51,49,52,50,48,49,50,48,13,
  78     /* lc label */     80,87,65,48,48,52,49,48,56,51,49,48,48,48,70,73,82,83,84,32,67,76,65,83,83,32,77,65,73,76,126,48,13};
  79
  80  char l_d3[] =        {90,87,48,52,48,48,56,51,49,52,50,48,49,50,48,13,
  81     /* priority */     80,87,65,48,48,53,53,48,56,51,49,48,48,48,80,82,73,79,82,73,84,89,32,77,65,73,76,126,48,13};
  82
  83  char l_d4[] =        {80,87,65,48,48,56,48,48,49,48,49,48,48,48};
  84
  85  int ln_d2 = 49;
  86  int ln_d3 = 46;
  87  int ln_d1 = 198;
  88  int ln_clear = 3;
  89
  90  char priort[] = "P R I O R I T Y   M A I L ";
  91  char far *v;
  92
  93  float prior();
  94
  95  main()
  96  {
  97
  98         unsigned int cc=1,c1=0;
  99         unsigned int t=0,is=0,lc=0;
 100         char l=0,bp=0,c=0,a=0,e,e1;
 101         int lb,oz1,oz2,koz,kl;
 102         float oz,p,oz3;
 103         char time[10],zone1,zone2;
 104         int wt;
 105
 106
 107         v = (char far *)0x88000000;
 108
 109         while(inp(889) != 223)
```

```
Line#  Source Line
 110          {
 111                  system("cls");
 112                  printf("Printer not ready.\n\nPress any key to retry...");
 113                  c = getch();
 114          }
 115          c = 0;
 116
 117          open_com();
 118          fprintf(stdprn,"%c",18);
 119          init_label();
 120          cls();
 121  /*          stream2 = fopen("blank.dat","w");
 122          stream = fopen("status.dat","r+");
 123          fseek(stream,0L,SEEK_SET);
 124          e = fgetc(stream);
 125
 126          if(e == '1')
 127          {
 128                  printf("Improper shutdown !!\n\n");
 129                  printf("Do you wish to continue where you left off (Y/N) ? ");
 130                  do
 131                  {
 132                          e1 = getch();
 133
 134                  } while(e1 != 'Y' && e1 != 'y' && e1 != 'N' && e1 !='n');
 135
 136                  if (e1 == 'y' || e1 == 'Y')
 137                  {
 138                          stream1 = fopen("pieces.dat","a+");
 139                          fscanf(stream,"%5u %5u %5u\n",&cc,&total_lc,&total_pm);
 140                  }
 141                  else
 142                  {
 143                          stream1 = fopen("pieces.dat","w");
 144                          cls();
 145                  }
 146          }
 147          if(e == '2')
 148          {
 149                  print();
 150                  print1();
 151                  _setvideomode(_DEFAULTMODE);
 152                  exit(0);
 153          }
 154
 155          if(e == '3' || e == EOF)
 156          {
 157                  stream1 = fopen("pieces.dat","w");
 158          } */
 159
 160
 161  /*          _setvideomode(_HRESBW);
 162          _setvisualpage(0); */
 163
 164     /*     stream = fopen("one.dat","r"); */
```

```
Line#  Source Line                                                    Microsoft C Compiler Version 5.10

 165        stream1 = fopen("pieces.dat","w");
 166
 167    /*     for(t=0;t<10;t++)
 168                buffer[t] = (char far *)malloc((unsigned int)_imagesize(301,81,334,104));
 169
 170        cls();
 171
 172        is = _imagesize(301,81,334,104);
 173
 174        for(t=0;t<=is;t++)
 175                *(buffer[1]+t) = fgetc(stream);
 176        for(t=0;t<=is;t++)
 177                *(buffer[2]+t) = fgetc(stream);
 178        for(t=0;t<=is;t++)
 179                *(buffer[3]+t) = fgetc(stream);
 180        for(t=0;t<=is;t++)
 181                *(buffer[4]+t) = fgetc(stream);
 182        for(t=0;t<=is;t++)
 183                *(buffer[5]+t) = fgetc(stream);
 184        for(t=0;t<=is;t++)
 185                *(buffer[6]+t) = fgetc(stream);
 186        for(t=0;t<=is;t++)
 187                *(buffer[7]+t) = fgetc(stream);
 188        for(t=0;t<=is;t++)
 189                *(buffer[8]+t) = fgetc(stream);
 190        for(t=0;t<=is;t++)
 191                *(buffer[9]+t) = fgetc(stream);
 192        for(t=0;t<=is;t++)
 193                *(buffer[0]+t) = fgetc(stream);
 194
 195        fclose(stream); */
 196
 197        get_zips();
 198        get_charges();
 199
 200        cursor_off();
 201
 202        screen0();
 203
 204
 205       /*  check_date(); */
 206
 207        /*cc = get_id_num();*/
 208
 209       /*  screen1();  */
 210
 211
 212        champ1();
 213
 214        tare = lbs;
 215
 216        do
 217        {
 218
 219           /*     display_num(cc);    */
```

```
Line#  Source Line

 220
 221                conv_cc(cc);
 222
 223                bp = champ1();
 224
 225                if (bp != 1)
 226                {
 227                        lbsav = lbs;
 228                        tare = lbs;
 229                        c = getch();
 230                        cc--;
 231                }
 232
 233                else
 234                {
 235                        lbs1 = (tare - lbs)/(float)715;
 236
 237                        lbs2 = lbs1;
 238
 239                        lbs1 = lbs1 * 1000;
 240                        lbs3 = (unsigned int)lbs1;
 241                        if (lbs1-lbs3 > .5)
 242                                lbs3++;
 243
 244                        lbs3 = lbs3/1000;
 245                        lbs1 = lbs3;
 246
 247                        lb = lbs2;
 248                        oz = (lbs1 - lb) * 16;
 249                        oz2 = oz * 10;
 250                        oz3 = oz * 10;
 251                        if ((oz3 - oz2) > .5)
 252                                oz2++;
 253
 254                        oz3 = oz2;
 255                        oz3 = oz3/10;
 256
 257                        oz1 = oz;
 258                        if (oz > oz1)
 259                                oz1++;
 260
 261                        if (oz3 > 15.95 && oz3 <= 16.00)
 262                        {
 263                                oz1=0;
 264                                oz3=0.00;
 265                                oz = 0.00;
 266                                lb++;
 267                        }
 268
 269                        ozfinal = oz1;
 270                        lbfinal = lb;
 271
 272
 273                        if (oz1 > 11 || lb > 0)
 274                        {
```

Line# Source Line Microsoft C Compiler Version 5.10

```
275                     prior_label();
276
277                     for(t=0;t<26;t++)
278                     {
279                             *(v+1686+(t++)) = priort[t];
280                             *(v+1686+t) = 0x8F;
281                     }
282
283                     if((lb < 2) || (lb==2 && oz1==0))
284                     {
285                             kl = 2;
286                             koz = 0;
287                     }
288                     else
289                     {
290                             if (oz1>0)
291                                     kl=lb+1;
292                             else
293                                     kl = lb;
294                     }
295
296                     _settextposition(24,2);
297                     printf("%2d Lb  %3.2f Oz      ",lbfinal,oz);
298                     p = prior(lb,oz1,kl,koz);
299                     ptype = 1;
300                     if(oz1>0)
301                     {
302                             lb++;
303                             oz1=0;
304                     }
305             }
306             else
307             {
308                     firstc_label();
309                     ptype = 0;
310                     if (oz1 == 1)
311                             p = .35;
312                     if (oz1 == 2)
313                             p = .45;
314                     if (oz1 == 3)
315                             p = .65;
316                     if (oz1 == 4)
317                             p = .85;
318                     if (oz1 == 5)
319                             p = 1.05;
320                     if (oz1 == 6)
321                             p = 1.25;
322                     if (oz1 == 7)
323                             p = 1.45;
324                     if (oz1 == 8)
325                             p = 1.65;
326                     if (oz1 == 9)
327                             p = 1.85;
328                     if (oz1 == 10)
329                             p = 2.05;
```

```
Line#  Source Line                                                                                    Microsoft C Compiler Version 5.10

   330                                  if (oz1 == 11)
   331                                          p = 2.25;
   332
   333                                  _settextposition(11,44);
   334                                  _outtext("1st Class              ");
   335                                  _settextposition(24,25);
   336                                  printf("          Charge %2.2f     ",p);
   337                          }
   338
   339                          _settextposition(24,2);
   340                          printf("%2d Lb  %3.2f Oz      ",lbfinal,oz);
   341
   342                          _strtime(time);
   343                  }
   344
   345                  if (bp == 1)            /* no key hit */
   346                  {
   347                          if (lc == 0)
   348                                  header();
   349
   350                          if (zone == 1)
   351                                  zone2 = 'X';
   352                          else
   353                                  zone2 = zone + 48;
   354
   355                          if (ptype == 0)
   356                                  fprintf(stdprn,"    %5d        %s        1C     %2d lb %5.2f oz        $ %6.2f\n",cc,time,lbfin
al,oz,p);
   357                          else
   358                                  fprintf(stdprn,"    %5d        %s        P%c     %2d lb %5.2f oz        $ %6.2f\n",cc,time,zone
2,lbfinal,oz,p);
   359                          lc++;
   360                          if (lc > 50)
   361                          {
   362                                  lc=0;
   363                                  fprintf(stdprn,"|----------|----------------|-------|--------------------|----------------|\n"
);
   364                                  fprintf(stdprn,"%c",12);
   365                                  fflush(stdprn);
   366                          }
   367                  }
   368                  else                    /* key hit has occured */
   369                  {
   370                          if (c == 32)
   371                          {
   372                                  total_post = total_post - p;
   373                                  total_oz_1c = total_oz_1c - oz1;
   374                                  total_lb_1c = total_lb_1c - lb;
   375                                  total_1c--;
   376
   377                                  lb=1;
   378                                  oz1=0;
   379                                  k1=2;
   380                                  koz=0;
   381                                  p = prior(lb,oz1,k1,koz);
   382                                  fprintf(stdprn,"    %5d    ***** Piece Changed to Priority Mail *****        $ %6.2f\n",cc,p);
```

```
383                     bp = 1;
384                     ptype = 1;      /* now priority */
385             }
386
387             if (c == '+')
388             {
389                     cc++;
390                     fprintf(stdprn,"            ***** Manual ID Increase *****\n");
391                     conv_cc(cc);
392             }
393
394             if (c == '-')
395             {
396                     cc--;
397                     fprintf(stdprn,"            ***** Manual ID Decrease *****\n");
398                     total_post = total_post - p;
399                     if (ptype == 0)
400                     {
401                             total_oz_lc = total_oz_lc - ozl;
402                             total_lb_lc = total_lb_lc - lb;
403                             total_lc--;
404                     }
405                     else if (ptype == 1)
406                     {
407                             total_oz_pm = total_oz_pm - ozl;
408                             total_lb_pm = total_lb_pm - lb;
409                             total_pm--;
410                     }
411                     conv_cc(cc);
412             }
413
414
415             if (c == 0)
416             {
417                     c = getch();
418                     if (c==61)
419                     {
420                             _setcolor(15);
421                             _settextposition(17,32);
422                             _outtext("ZDDDDDDDDDDD?");
423                             _settextposition(18,32);
424                             _outtext("3  ON HOLD  3");
425                             _settextposition(19,32);
426                             _outtext("@DDDDDDDDDDDY");
427                             _setcolor(7);
428
429                             do {
430                                     c = getch();
431                                     t=0;
432                                     if (c==0)
433                                     {
434                                             t=1;
435                                             c=getch();
436                                             if (c==61)
437                                                     t=2;
438                                     }
```

```
439                                     } while(t==0 || t==1);
440                                     _settextposition(17,32);
441                                     _outtext("                    ");
442                                     _settextposition(18,32);
443                                     _outtext("                    ");
444                                     _settextposition(19,32);
445                                     _outtext("                    ");
446                                     lbsav = 64000;
447                                     bp = champl();
448                                     bp = 0;
449                             }
450
451                     }
452                     fflush(stdprn);
453
454             }
455
456             if (bp == 1)
457             {
458                     total_post = total_post + p;
459
460                     if (ptype == 0)
461                     {
462                             total_oz_lc = total_oz_lc + ozl;
463                             total_lb_lc = total_lb_lc + lb;
464                             total_lc++;
465
466                     }
467                     else if (ptype == 1)
468                     {
469                             total_oz_pm = total_oz_pm + ozl;
470                             total_lb_pm = total_lb_pm + lb;
471                             total_pm++;
472                     }
473
474                     if(total_oz_lc > 16.0)
475                     {
476                             total_lb_lc++;
477                             total_oz_lc = total_oz_lc - 16.0;
478                     }
479
480                     if(total_oz_pm > 16.0)
481                     {
482                             total_lb_pm++;
483                             total_oz_pm = total_oz_pm - 16.0;
484                     }
485
486                     if (ptype == 0)
487                             wt = ozl;
488                     else
489                             wt = lb;
490
491
492                     fseek(stream,0L,SEEK_SET);
493                     fprintf(stream,"%c%5u %5u %5u\n",'1',(cc+1),total_lc,total_pm);
494                     fprintf(stream1,"%5d %1d %2d %1d",cc,zone,wt,ptype);
```

```
495
496                     if ((float)lc/10 == (int)lc/10)
497                     {
498                             fflush(stream);
499                             fflush(stream1);
500                     }
501                     fflush(stdprn);
502             }
503
504             zone = 0;
505
506             cc++;
507
508             if(cc > 32000)
509                     cc=1;
510
511             tare = lbs;
512
513             _settextposition(9,44);
514             printf("%s",cc_buffer);
515
516             _settextposition(14,44);
517             printf("%u",total_lc);
518
519             _settextposition(16,44);
520             printf("%u",total_pm);
521
522             fflush(stdin);
523
524             if( c == 59)
525             {
526                     _setcolor(15);
527                     _settextposition(16,18);
528                     _outtext("ZDDDDDDDDDDDDDDDDDDDDDDDDDDDDDDDDDDDDDDDD?");
529                     _settextposition(17,18);
530                     _outtext("3 Are You Sure You Want to Quit ? (Y/N) 3");
531                     _settextposition(18,18);
532                     _outtext("@DDDDDDDDDDDDDDDDDDDDDDDDDDDDDDDDDDDDDDDDY");
533
534                     do {
535                             a = getch();
536
537                     } while (a != 'y' && a != 'Y' && a != 'n' && a != 'N');
538
539                     if (a == 'n' || a == 'N')
540                     {
541                             _settextposition(16,18);
542                             _outtext("                                        ");
543                             _settextposition(17,18);
544                             _outtext("                                        ");
545                             _settextposition(18,18);
546                             _outtext("                                        ");
547                             c = 0;
548                     }
549                     _setcolor(7);
```

```
Line#  Source Line                                                    Microsoft C Compiler Version 5.10

  550                 }
  551         } while(c != 59);
  552
  553         fclose(stream1);
  554
  555         fprintf(stdprn,"|-----------|---------------|-------|-------------------|----------------|\n");
  556
  557      /*    if (lc > 40)
  558                 fprintf(stdprn,"%c",12);     */
  559
  560
  561  /*        fprintf(stdprn,"\n\n");
  562         fprintf(stdprn,"%6d - 1st Class Pieces \n\n",total_1c);
  563         fprintf(stdprn,"%6d - Priority Pieces \n",total_pm);    */
  564         fprintf(stdprn,"%c",12);
  565         fflush(stdprn);
  566
  567         fseek(stream,0L,SEEK_SET);
  568         fprintf(stream,"%c",'2');
  569
  570         print();
  571         print1();
  572         fseek(stream,0L,SEEK_SET);
  573         fprintf(stream,"%c",'3');
  574         _setvideomode(_DEFAULTMODE);
  575         exit(0);
  576  }

main  Local Symbols

Name                        Class   Type              Size   Offset  Register

lc. . . . . . . . . . . . . auto                            -003c
time. . . . . . . . . . . . auto                            -003a
lb. . . . . . . . . . . . . auto                            -0030
zone2 . . . . . . . . . . . auto                            -002e
zone1 . . . . . . . . . . . auto                            -002c
is. . . . . . . . . . . . . auto                            -002a
l . . . . . . . . . . . . . auto                            -0028
oz3 . . . . . . . . . . . . auto                            -0026
oz2 . . . . . . . . . . . . auto                            -0022
wt. . . . . . . . . . . . . auto                            -0020
oz1 . . . . . . . . . . . . auto                            -001e
oz. . . . . . . . . . . . . auto                            -001c
k1. . . . . . . . . . . . . auto                            -0018
cc. . . . . . . . . . . . . auto                            -0016
e1. . . . . . . . . . . . . auto                            -0014
e . . . . . . . . . . . . . auto                            -0012
c1. . . . . . . . . . . . . auto                            -0010
t . . . . . . . . . . . . . auto                            -000e
koz . . . . . . . . . . . . auto                            -000c
c . . . . . . . . . . . . . auto                            -000a
bp. . . . . . . . . . . . . auto                            -0008
a . . . . . . . . . . . . . auto                            -0006
```

Microsoft C Compiler Version 5.10 main Local Symbols

| Name | Class | Type | Size | Offset | Register |
|---|---|---|---|---|---|
| p . . . . . | auto | | | -0004 | |

```
577
578  screen0()
579  {
580          unsigned int g;
581          char far *v;
582
583          v = (char far *)0xB8000000;
584
585          for(g=0;g<160;g++)
586          {
587                  *(v+g) = 205;
588                  *(v+320+g) = 205;
589                  *(v+3842+g) = 205;
590                  *(v+3522+g) = 205;
591                  *(v+(++g)) = 15;
592                  *(v+320+g) = 15;
593                  *(v+3842+g) = 15;
594                  *(v+3522+g) = 15;
595
596
597          }
598          for(g=1;g<24;g++)
599          {
600                  *(v+(g*160)) = 186;
601                  *(v+(g*160)+1) = 15;
602                  *(v+(g*160)+158) = 186;
603                  *(v+(g*160)+159) = 15;
604          }
605          *v = 201;
606          *(v+1) = 15;
607          *(v+158) = 187;
608          *(v+159) = 15;
609          *(v+3998) = 188;
610          *(v+3999) = 15;
611          *(v+3840) = 200;
612          *(v+3841) = 15;
613          *(v+320) = 204;
614          *(v+321) = 15;
615          *(v+478) = 185;
616          *(v+479) = 15;
617          *(v+3520) = 204;
618          *(v+3521) = 15;
619          *(v+3678) = 185;
620          *(v+3679) = 15;
621
622
623
624      /*      _setactivepage(2);
```

```
Line#  Source Line                                                    Microsoft C Compiler Version 5.10

   625          _rectangle(_GFILLINTERIOR,0,0,639,3);
   626          _rectangle(_GFILLINTERIOR,0,196,639,199);
   627          _rectangle(_GFILLINTERIOR,0,179,639,181);
   628          _rectangle(_GBORDER,0,1,639,227); */
   629
   630          _settextposition(2,3);
   631          _outtext("(c) 1989          The Champ - Heavyweight Mail Processor          ver 1.0");
   632        /*   _rectangle(_GFILLINTERIOR,0,21,639,24);  */
   633
   634          _settextposition(9,27);
   635          _outtext("   Piece ID #  :");
   636          _settextposition(11,27);
   637          _outtext("  Piece Class  :");
   638          _settextposition(14,27);
   639          _outtext("# of 1st Class :");
   640          _settextposition(16,27);
   641          _outtext("# of Priority  :");
   642  }

screen0  Local Symbols

Name                        Class   Type              Size   Offset  Register

g . . . . . . . . . . . . . auto                            -0006
v . . . . . . . . . . . . . auto                            -0004

   643
   644  header()
   645  {
   646          char *date1;
   647
   648          _settextposition(15,34);
   649          _strdate(date1);
   650
   651          fprintf(stdprn,"THE CHAMP                    TRANSACTION REPORT                    %s\n",date1);
   652          fprintf(stdprn," \n");
   653          fprintf(stdprn,"¦----ID #---¦---Time-Stamp---¦-Class-¦-------Weight-------¦-----Postage-----¦\n");
   654          fprintf(stdprn,"\n");
   655          fflush(stdprn);
   656  }

header  Local Symbols

Name                        Class   Type              Size   Offset  Register

date1 . . . . . . . . . . . auto                            -0004

   657
   658
   659  conv_cc(r)
   660  unsigned int r;
   661  {
   662
```

```
Line#  Source Line

   663          char *p;
   664          char temp;
   665
   666          my_itoa (r,cc_buffer);     /* convert in base 10 */
   667
   668  }
```

conv_cc  Local Symbols

| Name | Class | Type | Size | Offset | Register |
|---|---|---|---|---|---|
| temp. . . . . | auto | | | -0006 | |
| p . . . . . | auto | | | -0004 | |
| r . . . . . | param | | | 0006 | |

```
   669  my_itoa(i,c)
   670  unsigned int i;
   671  char *c;
   672  {
   673          unsigned int l1,l2,l3,l4,l5,is;
   674
   675          is = i;
   676
   677          l1 = is/10000;
   678          c[0] = l1+48;
   679          l1 = 10000*l1;
   680          l2 = (is-l1)/1000;
   681          c[1] = l2+48;
   682          l2 = l2*1000;
   683          l3 = (is-l1-l2)/100;
   684          c[2] = l3+48;
   685          l3 = l3*100;
   686          l4 = (is-l1-l2-l3)/10;
   687          c[3] = l4+48;
   688          l4 = l4*10;
   689          l5 = (is-l1-l2-l3-l4);
   690          c[4] = l5+48;
   691  }
```

my_itoa  Local Symbols

| Name | Class | Type | Size | Offset | Register |
|---|---|---|---|---|---|
| l3. . . . . | auto | | | -000c | |
| l2. . . . . | auto | | | -000a | |
| l1. . . . . | auto | | | -0008 | |
| is. . . . . | auto | | | -0006 | |
| l5. . . . . | auto | | | -0004 | |
| l4. . . . . | auto | | | -0002 | |
| i . . . . . | param | | | 0006 | |
| c . . . . . | param | | | 0008 | |

```
   692
```

Microsoft C Compiler Version 5.10

```
Line#  Source Line

   693  champ1()
   694  {
   695          char bp=0;
   696
   697
   698          do
   699          {
   700                  gwt();
   701
   702                  _settextposition(23,1);
   703
   704                  if (stable == 1)
   705                  {
   706                          if ((bp == 0) && (lbs < lbsav-20))
   707                          {
   708                                  tone1();
   709                                  bp = 1;
   710                                  lbsav = lbs;
   711                          }
   712                          else if ((bp == 0) && (lbs > lbsav + 20))
   713                          {
   714                                  lbsav = lbs;
   715                                  tare = lbs;
   716                          }
   717                          _settextposition(24,70);
   718                          _outtext("Stable  ");
   719                  }
   720                  else
   721                  {
   722                          bp = 0;
   723                          _settextposition(24,70);
   724                          _outtext("Unstable");
   725                  }
   726
   727                  _settextposition(12,35);
   728
   729
   730          } while((bp != 1) && !kbhit());
   731
   732          return(bp);
   733
   734  }

champ1  Local Symbols

Name                        Class   Type            Size   Offset  Register

bp. . . . . . . . . . . . . auto                           -0002

   735
   736  open_com()
   737  {
   738          unsigned char temp;
   739
```

```
Line#  Source Line                                                                    Microsoft C Compiler Version 5.10

   740          temp = _bios_serialcom(_COM_INIT,COM_NUM,_COM_CHR8 | _COM_NOPARITY | _COM_1200 | _COM_STOP1);
   741          temp = _bios_serialcom(_COM_INIT,COM_NUM2,_COM_CHR7 | _COM_EVENPARITY | _COM_4800 | _COM_STOP1);
   742  }


open_com  Local Symbols

Name                        Class   Type              Size   Offset  Register

temp. . . . . . . . . . . . auto                             -0002

   743
   744
   745  check_date()
   746  {
   747
   748          struct dosdate_t date;
   749          char c,k;
   750
   751          _rectangle(_GBORDER,248,105,357,125);
   752          _rectangle(_GBORDER,252,107,353,123);
   753
   754          _dos_getdate(&date);
   755
   756          _settextposition(15,34);
   757          printf("%2d-%2d-%4d",date.month,date.day,date.year);
   758
   759          _settextposition(11,24);
   760          printf("Is Today's Date Correct (Y/N) ? ");
   761          _settextposition(11,56);
   762
   763          do
   764          {
   765                  c = getch();
   766
   767          } while (c != 'Y' && c != 'y' && c != 'N' && c != 'n');
   768
   769          if ( c == 'n' || c == 'N')
   770          {
   771                  _settextposition(15,34);
   772                  _outtext("          ");
   773
   774                  get_cha(10,34,15);
   775          }
   776          for(k=11;k<20;k++)
   777          {
   778                  _settextposition(k,5);
   779                  _outtext("                                                          ");
   780          }
   781
   782  }
```

Microsoft C Compiler Version 5.10 check_date Local Symbols

| Name | Class | Type | Size | Offset | Register |
|---|---|---|---|---|---|
| date. . . . . | auto | | | -000a | |
| k . . . . . | auto | | | -0004 | |
| c . . . . . | auto | | | -0002 | |

```
783
784  get_cha(t,locx,locay)
785  char t;      /* number of chars to get */
786  char locx,locay;
787  {
788          char c,l=0;
789          char locax,t1=0,t2;
790
791          locax = locx;
792
793          for(t2=0;t2<20;t2++)
794                  m[t2] = '\0';
795
796          _settextposition(locay,locax);
797
798          do
799          {
800             do
801             {
802                  _settextposition(locay,locax);
803                  _outtext("_");
804                  _settextposition(locay,locax);
805
806                  c = getch();
807
808
809                  if ((( c >= '0' && c <= '9') || c == '-') && t1 < t)
810                  {
811                           printf("%c",c);
812                           m[t1] = c;
813                           t1++;
814                           locax++;
815                  }
816                  if ( c == 8 && t1 > 0)
817                  {
818                           _outtext(" ");
819                           _settextposition(locay,locax-1);
820                           _outtext(" ");
821                           _settextposition(locay,locax+t1);
822                           t1--;
823                           locax--;
824                           m[t1]= '\0';
825                  }
826
827          } while( t1 < t && c != 13);
828
829          if (c != 13)
```

```
Line#  Source Line                                                    Microsoft C Compiler Version 5.10

   830         {
   831
   832                 _settextposition(locay,locax);
   833
   834                 _outtext("_");
   835
   836                 c = getch();
   837
   838                 if (c == 13)
   839                         l = 1;
   840                 else if (c == 8)
   841                 {
   842                         _settextposition(locay,locax);
   843                         _outtext(" ");
   844                         _settextposition(locay,locax-1);
   845                         _outtext(" ");
   846                         _settextposition(locay,locax+t1);
   847                         t1--;
   848                         locax--;
   849                 }
   850         }
   851         else
   852         {
   853                 l = 1;
   854                 _outtext(" ");
   855         }
   856
   857       } while (l == 0);
   858
   859  }

get_cha  Local Symbols

Name                        Class   Type              Size   Offset  Register

l . . . . . . . . . . . . . auto                             -000a
locax . . . . . . . . . . . auto                             -0008
t2. . . . . . . . . . . . . auto                             -0006
t1. . . . . . . . . . . . . auto                             -0004
c . . . . . . . . . . . . . auto                             -0002
t . . . . . . . . . . . . . param                             0006
locx. . . . . . . . . . . . param                             0008
locay . . . . . . . . . . . param                             000a

   860
   861  get_id_num()
   862  {
   863
   864         char k;
   865         unsigned int i;
   866
   867         _rectangle(_GBORDER,248,105,357,125);
   868         _rectangle(_GBORDER,252,107,353,123);
   869
```

```
Line#  Source Line                                                    Microsoft C Compiler Version 5.10

   870
   871          do
   872          {
   873                  _settextposition(11,23);
   874                  _outtext("    Enter Starting Label ID");
   875
   876                  _settextposition(15,36);
   877                  _outtext("      ");
   878                  _settextposition(15,36);
   879
   880                  get_cha(5,36,15);
   881
   882                  i = atoi(m);
   883
   884                  if(i > 32000)
   885                          tone1();
   886
   887          } while (i > 32000);
   888
   889          for(k=11;k<20;k++)
   890          {
   891                  _settextposition(k,5);
   892                  _outtext("
   893          }
   894
   895          return(i);
   896  }

get_id_num  Local Symbols

Name                        Class   Type              Size   Offset  Register

k . . . . . . . . . . . . . auto                             -0004
i . . . . . . . . . . . . . auto                             -0002

   897
   898  float prior(lb,oz1,kl,koz)
   899  int lb,oz1;
   900  int kl,koz;
   901  {
   902          char zone1;
   903          float p;
   904
   905          priority();
   906          zone1 = zone;
   907          if(zone1==1 || zone1==2 || zone1==3)
   908                  zone1=3;
   909          if (kl==2)
   910          {
   911                  lb = 2;
   912                  _settextposition(24,25);
   913                  _outtext("      ");
   914          }
   915          else
```

```
916         {
917                 _settextposition(24,25);
918                 printf("Zone %c",zone+48);
919         }
920
921         p = (zc[zone1-3][kl]);
922         p = p/100;
923         _settextposition(24,34);
924         printf("Charge %2.2f    ",p);
925         return(p);
926 }
```

prior Local Symbols

| Name | Class | Type | Size | Offset | Register |
|---|---|---|---|---|---|
| zone1 . . . . . | auto | | | -0006 | |
| p . . . . . | auto | | | -0004 | |
| lb. . . . . | param | | | 0006 | |
| ozl . . . . . | param | | | 0008 | |
| kl. . . . . | param | | | 000a | |
| koz . . . . . | param | | | 000c | |

```
927
928 init_label()
929 {
930         int g;
931
932         for(g=0;g<ln_clear;++g)
933                 _bios_serialcom(_COM_SEND,COM_NUM2,l_clear[g]);
934
935         for(g=0;g<ln_dl;++g)
936                 _bios_serialcom(_COM_SEND,COM_NUM2,l_dl[g]);
937 }
```

init_label Local Symbols

| Name | Class | Type | Size | Offset | Register |
|---|---|---|---|---|---|
| g . . . . . | auto | | | -0002 | |

```
938
939 prior_label()
940 {
941         int g;
942
943         for(g=0;g<ln_d3;++g)
944                 _bios_serialcom(_COM_SEND,COM_NUM2,l_d3[g]);
945
946         for(g=0;g<14;++g)
947                 _bios_serialcom(_COM_SEND,COM_NUM2,l_d4[g]);
948
949         _bios_serialcom(_COM_SEND,COM_NUM2,cc_buffer[0]);
```

```
Line#  Source Line

   950          _bios_serialcom(_COM_SEND,COM_NUM2,cc_buffer[1]);
   951          _bios_serialcom(_COM_SEND,COM_NUM2,cc_buffer[2]);
   952          _bios_serialcom(_COM_SEND,COM_NUM2,cc_buffer[3]);
   953          _bios_serialcom(_COM_SEND,COM_NUM2,cc_buffer[4]);
   954          _bios_serialcom(_COM_SEND,COM_NUM2,126);
   955          _bios_serialcom(_COM_SEND,COM_NUM2,49);
   956          _bios_serialcom(_COM_SEND,COM_NUM2,13);
   957
   958  }

prior_label  Local Symbols

Name                        Class   Type              Size   Offset  Register

g . . . . . . . . . . . . . auto                             -0002

   959
   960  firstc_label()
   961  {
   962          int g;
   963
   964          for(g=0;g<ln_d2;++g)
   965                  _bios_serialcom(_COM_SEND,COM_NUM2,l_d2[g]);
   966
   967          for(g=0;g<14;++g)
   968                  _bios_serialcom(_COM_SEND,COM_NUM2,l_d4[g]);
   969
   970          _bios_serialcom(_COM_SEND,COM_NUM2,cc_buffer[0]);
   971          _bios_serialcom(_COM_SEND,COM_NUM2,cc_buffer[1]);
   972          _bios_serialcom(_COM_SEND,COM_NUM2,cc_buffer[2]);
   973          _bios_serialcom(_COM_SEND,COM_NUM2,cc_buffer[3]);
   974          _bios_serialcom(_COM_SEND,COM_NUM2,cc_buffer[4]);
   975          _bios_serialcom(_COM_SEND,COM_NUM2,126);
   976          _bios_serialcom(_COM_SEND,COM_NUM2,49);
   977          _bios_serialcom(_COM_SEND,COM_NUM2,13);
   978
   979  }

firstc_label  Local Symbols

Name                        Class   Type              Size   Offset  Register

g . . . . . . . . . . . . . auto                             -0002

   980  cls()
   981  {
   982          unsigned int g;
   983
   984          for(g=0;g<4000;g++)
   985          {
   986                  *(v+g) = 32;
   987                  *(v+g+1) = 07;
   988                  g++;
```

```
 Line#  Source Line

    989          }
    990  }
```

cls Local Symbols

| Name | Class | Type | Size | Offset | Register |
|---|---|---|---|---|---|
| g . . . . . . . . . . . . | auto | | | -0002 | |

```
    991 }
    992  cursor_off()
    993  {
    994          union REGS inregs;
    995
    996          inregs.h.ah = 1;
    997          inregs.h.ch = 0x0f;
    998          inregs.h.cl = 0x00;
    999
   1000          int86(0x10,&inregs,&inregs);
   1001  }
```

cursor_off Local Symbols

| Name | Class | Type | Size | Offset | Register |
|---|---|---|---|---|---|
| inregs. . . . . . . . . . | auto | | | -000e | |

Global Symbols

| Name | Class | Type | Size | Offset |
|---|---|---|---|---|
| _bios_serialcom . . . . . | extern | far function | *** | *** |
| _dos_getdate. . . . . | extern | far function | *** | *** |
| _fac. . . . . | extern | double | 8 | *** |
| _iob. . . . . | extern | struct/array | *** | *** |
| _outtext. . . . . | extern | far function | *** | *** |
| _rectangle. . . . . | extern | far function | *** | *** |
| _setcolor . . . . . | extern | far function | *** | *** |
| _settextposition. . . . . | extern | far function | *** | *** |
| _setvideomode . . . . . | extern | far function | *** | *** |
| _strdate. . . . . | extern | far function | *** | *** |
| _strtime. . . . . | extern | far function | *** | *** |
| atoi. . . . . | extern | far function | *** | *** |
| buffer. . . . . | common | struct/array | 40 | *** |
| cc_buffer . . . . . | common | struct/array | 10 | *** |
| champ1. . . . . | global | far function | *** | 1028 |
| check_date. . . . . | global | far function | *** | 115e |
| cls . . . . . | global | far function | *** | 18e8 |
| conv_cc . . . . . | global | far function | *** | 0f44 |
| cursor_off. . . . . | global | far function | *** | 192c |
| exit. . . . . | extern | far function | *** | *** |
| fclose. . . . . | extern | far function | *** | *** |

Global Symbols

| Name | Class | Type | Size | Offset |
|---|---|---|---|---|
| fflush. . . . . | extern | far function | *** | *** |
| firstc_label. . . . . | global | far function | *** | 17d6 |
| fopen . . . . . | extern | far function | *** | *** |
| fprintf . . . . . | extern | far function | *** | *** |
| fseek . . . . . | extern | far function | *** | *** |
| get_cha . . . . . | global | far function | *** | 1283 |
| get_charges . . . . . | extern | far function | *** | *** |
| get_id_num. . . . . | global | far function | *** | 1486 |
| get_zips. . . . . | extern | far function | *** | *** |
| getch . . . . . | extern | far function | *** | *** |
| gwt . . . . . | extern | far function | *** | *** |
| header. . . . . | global | far function | *** | 0ebe |
| init_label. . . . . | global | far function | *** | 1660 |
| inp . . . . . | extern | far function | *** | *** |
| int86 . . . . . | extern | far function | *** | *** |
| kbhit . . . . . | extern | far function | *** | *** |
| l_clear . . . . . | global | struct/array | 3 | 03f6 |
| l_d1. . . . . | global | struct/array | 199 | 03fa |
| l_d2. . . . . | global | struct/array | 49 | 04c2 |
| l_d3. . . . . | global | struct/array | 46 | 04f4 |
| l_d4. . . . . | global | struct/array | 14 | 0522 |
| last_label. . . . . | global | char | 1 | 03e0 |
| lbfinal . . . . . | common | unsigned int | 2 | *** |
| lbs . . . . . | common | unsigned int | 2 | *** |
| lbs1. . . . . | common | float | 4 | *** |
| lbs2. . . . . | common | float | 4 | *** |
| lbs3. . . . . | common | float | 4 | *** |
| lbsav . . . . . | common | unsigned int | 2 | *** |
| ln_clear. . . . . | global | int | 2 | 0536 |
| ln_d1 . . . . . | global | int | 2 | 0534 |
| ln_d2 . . . . . | global | int | 2 | 0530 |
| ln_d3 . . . . . | global | int | 2 | 0532 |
| m . . . . . | common | struct/array | 20 | *** |
| main. . . . . | global | far function | *** | 0000 |
| my_itoa . . . . . | global | far function | *** | 0f62 |
| open_com. . . . . | global | far function | *** | 1128 |
| ozfinal . . . . . | common | float | 4 | *** |
| print . . . . . | extern | far function | *** | *** |
| print1. . . . . | extern | far function | *** | *** |
| printf. . . . . | extern | far function | *** | *** |
| prior . . . . . | global | far function | *** | 1580 |
| prior_label . . . . . | global | far function | *** | 16c4 |
| priority. . . . . | extern | far function | *** | *** |
| priort. . . . . | global | struct/array | 27 | 0538 |
| ptype . . . . . | global | char | 1 | 03e2 |
| screen0 . . . . . | global | far function | *** | 0cc8 |
| stable. . . . . | common | char | 1 | *** |
| stream. . . . . | common | far pointer | 4 | *** |
| stream1 . . . . . | common | far pointer | 4 | *** |
| stream2 . . . . . | common | far pointer | 4 | *** |

Microsoft C Compiler Version 5.10

Global Symbols

| Name | Class | Type | Size | Offset |
|---|---|---|---|---|
| system. . . . . | extern | far function | *** | *** |
| tare. . . . . | common | unsigned int | 2 | *** |
| tone1 . . . . . | extern | far function | *** | *** |
| total_lc. . . . . | global | unsigned int | 2 | 03f0 |
| total_lb_lc . . . . . | global | unsigned int | 2 | 03f2 |
| total_lb_pm . . . . . | global | unsigned int | 2 | 03f4 |
| total_oz_lc . . . . . | global | float | 4 | 03e8 |
| total_oz_pm . . . . . | global | float | 4 | 03ec |
| total_pm. . . . . | common | unsigned int | 2 | *** |
| total_post. . . . . | global | float | 4 | 03e4 |
| v . . . . . | common | far pointer | 4 | *** |
| zc. . . . . | extern | struct/array | 852 | *** |
| zone. . . . . | global | char | 1 | 03e1 |

Code size = 195a (6490)
Data size = 0822 (2082)
Bss size  = 0000 (0)

No errors detected

Microsoft C Compiler Version 5.10

```
Line#  Source Line

     1  #include <stdio.h>
     2  #include <bios.h>
     3  #include <stdlib.h>
     4  #include <graph.h>
     5
     6  #define COM_NUM 1   /* should be 1 */
     7
     8  extern unsigned int lbs;
     9  extern char stable;
    10  extern char far *buffer[10];
    11
    12  gwt()
    13  {
    14
    15          unsigned int l,lbh,lbl,t=0,r=0;
    16          unsigned int ls[300];
    17          double lbt=0;
    18
    19          get_weight();
    20          lbl = lbs;
    21          lbh = lbs;
    22
    23          for(l=0;l<2;l++)
    24          {
    25                  get_weight();
    26
    27                  if (lbs < lbl)
    28                          lbl = lbs;
    29                  else
    30                          ls[t++] = lbs;
    31
    32                  if (lbs > lbh)
    33                          lbh = lbs;
    34                  else
    35                          ls[t++] = lbs;
    36                  if ((lbh-lbl) > 2)
    37                          l = 5;
    38
    39          }
    40
    41          if ((lbh - lbl) < 3)
    42          {
    43                  stable = 1;
    44                  for(r=0;r<t;r++)
    45                          lbt += ls[r];
    46
    47                  lbs = lbt/t;
    48
    49          }
    50          else
    51                  stable = 0;
    52
    53  }
```

gwt Local Symbols

| Name | Class | Type | Size | Offset | Register |
|---|---|---|---|---|---|
| ls. . . . . | auto | | | -026a | |
| l . . . . . | auto | | | -0012 | |
| lbl . . . . . | auto | | | -0010 | |
| lbh . . . . . | auto | | | -000e | |
| t . . . . . | auto | | | -000c | |
| r . . . . . | auto | | | -000a | |
| lbt . . . . . | auto | | | -0008 | |

```
54
55
56  get_weight()
57  {
58
59  /* This routine requests the scale's weight with any character */
60  /* and returns it in a count    */
61
62
63          unsigned char temp;
64          unsigned int com_char[6],c=0,i,j,j1;
65
66     /*   for(j1=0;j1<10;j1++)
67                 for(j=0;j<22222;j++); */
68
69          for(j=0;j<63000;j++);
70
71          temp = _bios_serialcom(_COM_SEND,COM_NUM,87);    /* ' ' */
72  /*         com_char[0] = 0;
73          com_char[1] = 0;
74          com_char[2] = 0;
75          com_char[3] = 0;
76          com_char[4] = 0;
77          com_char[5] = 0;*/
78
79          do
80          {
81                  c++;
82                  com_char[c] = _bios_serialcom(_COM_RECEIVE,COM_NUM,0);
83
84          } while(c < 2);
85
86          lbs = (com_char[1]*256) + com_char[2];
87
88          if (lbs < 32768)
89                  lbs = 32678 - lbs;
90
91
92  }
```

Microsoft C Compiler Version 5.10 get_weight Local Symbols

| Name | Class | Type | Size | Offset | Register |
|---|---|---|---|---|---|
| com_char. . . . . | auto | | | -0016 | |
| jl. . . . . | auto | | | -000a | |
| j . . . . . | auto | | | -0008 | |
| i . . . . . | auto | | | -0006 | |
| temp. . . . . | auto | | | -0004 | |
| c . . . . . | auto | | | -0002 | |

Global Symbols

| Name | Class | Type | Size | Offset |
|---|---|---|---|---|
| _bios_serialcom . . . . . | extern | far function | *** | *** |
| get_weight. . . . . | global | far function | *** | 011e |
| gwt . . . . . | global | far function | *** | 0000 |
| lbs . . . . . | extern | unsigned int | 2 | *** |
| stable. . . . . | extern | char | 1 | *** |

Code size = 019e (414)
Data size = 0004 (4)
Bss size = 0000 (0)

No errors detected

Line# Source Line Microsoft C Compiler Version 5.10

```
 1  #include <stdio.h>
 2
 3  extern float ozfinal;
 4  extern unsigned int lbfinal;
 5  extern char m[20];                    /* buffer for get_cha routine */
 6  extern char zone;
 7
 8  void sound();
 9
10  FILE *stream3;
11  char zip[1000];
12  int zc[6][71];
13  unsigned int pcs[32001],rec[32001];
14  char date[9];
15
16  int uz_tc,uz_tw;
17  float uz_tp;
18  int z3_tc,z3_tw;
19  float z3_tp;
20  int z4_tc,z4_tw;
21  float z4_tp;
22  int z5_tc,z5_tw;
23  float z5_tp;
24  int z6_tc,z6_tw;
25  float z6_tp;
26  int z7_tc,z7_tw;
27  float z7_tp;
28  int z8_tc,z8_tw;
29  float z8_tp;
30  int zt_tc;
31  float zt_tp;
32
33  priority()
34  {
35          char k;
36          unsigned int i,i1;
37
38          if ((lbfinal<2) || (lbfinal==2.00 && ozfinal==0.00))
39                  tone2();
40
41  /*          _settextposition(6,27);
42          _outtext("ZDDDDDDDDDDDDDDDDDDDD?\n");
43          _settextposition(7,27);
44          _outtext("3    PRIORITY MAIL    3\n");
45          _settextposition(8,27);
46          _outtext("@DDDDDDDDDDDDDDDDDDDDY\n"); */
47
48          if ((lbfinal<2) || (lbfinal==2.00 && ozfinal==0.00))
49          {
50            /*      _settextposition(16,10);
51                  _outtext("ZDDDDDDDDDDDDDDDDDDDDDDDDDDDDDDDDDDDDDDDDDDDDDDDDDDDDDDDDDDDDDDDDDDDD?");
52                  _settextposition(17,10);
53                  _outtext("3   This Priority Piece weighs between 12 ozs and 2 Lbs.  3");
54                  _settextposition(18,10);
55                  _outtext("3           No ZIP code or Zone is necessary.            3");
```

Microsoft C Compiler Version 5.10

```
Line#  Source Line
 56                 _settextposition(19,10);
 57                 _outtext("ºÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍÍ¼");
 58
 59                 for(i1=0;i1<2;++i1)
 60                         for(i=0;i<64000;++i);   */
 61
 62                 zone = 1;
 63         }
 64
 65         else               /* need to enter SCF code */
 66         {
 67                 tone3();
 68                 do
 69                 {
 70                         _settextposition(18,21);
 71                         _outtext("ÚÄÄÄÄÄÄÄÄÄÄÄÄÄÄÄÄÄÄÄÄÄÄÄÄÄÄÄÄÄÄÄÄÄÄÄÄÄÄÄÄÄÄÄÄ¿");
 72                         _settextposition(19,21);
 73                         _outtext("³    Enter 3 digit ZIP Code        ³");
 74                         _settextposition(20,21);
 75                         _outtext("ºÍÍÍÍÍÍÍÍÍÍÍÍÍÍÍÍÍÍÍÍÍÍÍÍÍÍÍÍÍÍÍÍÍÍÍÍÍÍ¼");
 76                         get_cha(3,49,19);
 77                         i = atoi(m);
 78                         if (zip[i] == 1)
 79                         {
 80                                 _settextposition(19,22);
 81                                 _outtext("          BAD ZIP CODE          ");
 82                                 sound(400);
 83                                 for(i1=0;i1<64000;i1++);
 84                         }
 85                 } while (zip[i] == 1);
 86
 87                 zone = zip[i];
 88
 89         }
 90
 91         _setcolor(0);
 92         _setcolor(15);
 93         _settextposition(6,27);
 94         _outtext("                    ");
 95         _settextposition(7,27);
 96         _outtext("                    ");
 97         _settextposition(8,27);
 98         _outtext("                    ");
 99
100         _settextposition(18,10);
101         _outtext("                                                    ");
102         _settextposition(19,10);
103         _outtext("                                                    ");
104         _settextposition(20,10);
105         _outtext("                                                    ");
106     /*     _settextposition(19,10);
107         _outtext("                                                    ");*/
108
109
110 }
```

priority Local Symbols

| Name | Class | Type | Size | Offset | Register |
|---|---|---|---|---|---|
| k . . . . . | auto | | | -0006 | |
| i1. . . . . | auto | | | -0004 | |
| i . . . . . | auto | | | -0002 | |

```
111
112
113  tone1()
114  {
115          sound(720);
116  }
117  tone2()
118  {
119          sound(1100);
120  }
121  tone3()
122  {
123          sound(400);
124          sound(1);
125          sound(400);
126  }
127  void sound(freq)
128  int freq;
129  {
130          unsigned i;
131          union {
132                  long divisor;
133                  unsigned char c[2];
134                } count;
135
136          unsigned char p;
137
138
139          count.divisor = 1193280 / freq;
140          outp(67,182);
141          outp(66,count.c[0]);
142          outp(66,count.c[1]);
143          p=inp(97);
144          outp(97,p | 3);
145
146          for(i=0;i<19000;++i);
147
148          outp(97,p);
149  }
```

sound Local Symbols

| Name | Class | Type | Size | Offset | Register |
|---|---|---|---|---|---|
| i . . . . . | auto | | | -0008 | |
| count . . . . . | auto | | | -0006 | |
| p . . . . . | auto | | | -0002 | |
| freq. . . . . | param | | | 0006 | |

```
150
151  get_zips()
152  {
153
154          int k;
155          char c;
156
157          if ((stream3 = fopen("zones.ind","r")) == NULL)
158          {
159                  printf("FILE ACCESS ERROR: File zones.ind not found\n");
160                  exit(1);
161          }
162
163          for(k=0;k<=999;k++)
164          {
165                  c = fgetc(stream3);
166                  c = c-48;
167                  if (c == EOF)
168                  {
169                          printf("FILE ACCESS ERROR: EOF found in zones.ind\n");
170                          exit(1);
171                  }
172                  zip[k] = c;
173          }
174         /*  zip[0] = 1; */
175
176          fclose(stream3);
177  }
```

get_zips Local Symbols

| Name | Class | Type | Size | Offset | Register |
|---|---|---|---|---|---|
| k . . . . . | auto | | | -0004 | |
| c . . . . . | auto | | | -0002 | |

```
178
179  get_charges()
180  {
181
182          int k,k1,i;
183          char c[5];
184
185          if ((stream3 = fopen("pmrt1.dat","r")) == NULL)
186          {
```

Microsoft C Compiler Version 5.10

```
Line#  Source Line

  187                 printf("FILE ACCESS ERROR: File pmrtl.dat not found\n");
  188                 exit(1);
  189         }
  190
  191         for(k1=2;k1<=70;k1++)
  192                 for(k=0;k<=5;k++)
  193                 {
  194                         c[0]=0; c[1]=0; c[2]=0; c[3]=0;
  195
  196                         c[0] = fgetc(stream3);
  197                         c[1] = fgetc(stream3);
  198                         c[2] = fgetc(stream3);
  199                         c[3] = fgetc(stream3);
  200                         c[4] = '\0';
  201
  202                         if(c[0] == EOF || c[1] == EOF || c[2] == EOF || c[3]== EOF)
  203                         {
  204                                 printf("FILE ACCESS ERROR: EOF found in pmrtl.dat.\n");
  205                                 exit(1);
  206                         }
  207                         i = atoi(c);
  208
  209                         zc[k][k1] = i;
  210                 }
  211
  212
  213
  214         fclose(stream3);
  215 }
```

get_charges  Local Symbols

| Name | Class | Type | Size | Offset | Register |
|---|---|---|---|---|---|
| k1. . . . . | auto | | | -000c | |
| k . . . . . | auto | | | -000a | |
| i . . . . . | auto | | | -0008 | |
| c . . . . . | auto | | | -0006 | |

```
  216 print()
  217 {
  218
  219         unsigned int c,ic,t,t1,r,ic1,tot_oz=0,temp_oz=0,temp_lb=0;
  220         int wt=0,rv=0;
  221         char zone,ptype,a,swap,lc=0,pc=1;
  222         float pr=0,prt=0;
  223         unsigned int tc=0;
  224
  225         cls();
  226
  227         if((stream3 = fopen("pieces.dat","r")) == NULL)
  228         {
  229                 printf("FILE ACCESS ERROR: File pieces.dat not found.\n");
  230                 exit(1);
```

```
231         }
232
233         _settextposition(1,1);
234         _outtext("Printing...");
235
236         ic = 0;
237         ic1= 0;
238         fseek(stream3,0L,SEEK_SET);
239         do
240         {
241                 rv = fscanf(stream3,"%5d %1d %2d %1d",&c,&zone,&wt,&ptype);
242                 if (rv != 0 && rv != EOF)
243                 {
244                         ic1++;
245
246                         if(ptype == 0 && c != pcs[ic])
247                         {
248                                 ic++;
249                                 pcs[ic] = c;
250                                 rec[ic] = ic1;
251                         }
252                         else if (ptype == 0 && c == pcs[ic])
253                         {
254                                 pcs[ic] = c;
255                                 rec[ic] = ic1;
256                         }
257                         else if (ptype == 1 && c == pcs[ic])
258                         {
259                                 ic--;   /* if changed to priority, back up one */
260                         }
261                 }
262         } while (rv != 0 && rv != EOF);
263
264         t1 = ic;
265         for(r=1;r<=ic;r++)
266         {
267             for(t=1;t<t1;t++)
268             {
269                 if (pcs[t+1] < pcs[t])
270                 {                               /* then swap */
271                         c = pcs[t];
272                         pcs[t] = pcs[t+1];
273                         pcs[t+1] = c;
274                         c = rec[t];
275                         rec[t] = rec[t+1];
276                         rec[t+1] = c;
277                         swap = 1;
278                 }
279             }
280             t1--;
281             if (swap == 0)
282                 r=ic+1;
283             else swap = 0;
284         }
285
```

```
Line#  Source Line                                                    Microsoft C Compiler Version 5.10

 286  /********************** done sorting **********************/
 287
 288          _strdate(date);
 289
 290          header1C(1);
 291          rewind(stream3);
 292
 293
 294          for(t=1;t<=ic;t++)
 295          {
 296              if(pcs[t+1] != pcs[t])
 297              {
 298                /*  for(r=1;r<=(rec[t]);r++)
 299                  {
 300                          rv = fscanf(stream3,"%5d %1d %2d %1d",&c,&zone,&wt,&ptype);
 301                  }*/
 302
 303                  fseek(stream3,(long)((rec[t]*12)-12),SEEK_SET);
 304                  rv = fscanf(stream3,"%5d %1d %2d %1d",&c,&zone,&wt,&ptype);
 305
 306                  if (wt == 1)
 307                          pr = .35;
 308                  if (wt == 2)
 309                          pr = .45;
 310                  if (wt == 3)
 311                          pr = .65;
 312                  if (wt == 4)
 313                          pr = .85;
 314                  if (wt == 5)
 315                          pr = 1.05;
 316                  if (wt == 6)
 317                          pr = 1.25;
 318                  if (wt == 7)
 319                          pr = 1.45;
 320                  if (wt == 8)
 321                          pr = 1.65;
 322                  if (wt == 9)
 323                          pr = 1.85;
 324                  if (wt == 10)
 325                          pr = 2.05;
 326                  if (wt == 11)
 327                          pr = 2.25;
 328
 329
 330                  lc++;
 331                  tc++;
 332
 333                  if(lc >= 45)
 334                  {
 335                          pc++;
 336                          fprintf(stdprn,"____________________________________________________________________________________\n");
 337                          fprintf(stdprn,"Page\n");
 338                          fprintf(stdprn,"Total: %4d              %5d\n",lc,temp_oz);
 339                          fprintf(stdprn,"%c",12);
 340                          lc=0;
```

```
Line#  Source Line                                                    Microsoft C Compiler Version 5.10

   341                         temp_oz = 0;
   342                         header1C(pc);
   343                 }
   344                 tot_oz = tot_oz + wt;
   345                 temp_oz = temp_oz + wt;
   346
   347                 prt = prt + pr;
   348                 fprintf(stdprn,"    %5d                %2d                    %5.2f              %7.2f\n",c,wt,pr,prt);
   349                 rewind(stream3);
   350             }
   351         }
   352         temp_lb = tot_oz / 16;
   353         temp_oz = tot_oz - (temp_lb * 16);
   354         fprintf(stdprn,"_____________________________________________________________________________________\n");
   355         fprintf(stdprn,"\nCUMULATIVE\n");
   356         fprintf(stdprn,"TOTALS              %6d PIECES                    %5d lbs, %2d oz\n",tc,temp_lb,temp_oz);
   357         fprintf(stdprn,"%c",12);
   358         fclose(stream3);
   359
   360         ps_3602(tc,temp_lb,temp_oz,prt);
   361 }
```

print  Local Symbols

| Name | Class | Type | Size | Offset | Register |
|---|---|---|---|---|---|
| tot_oz. . . . . | auto | | | -002c | |
| lc. . . . . | auto | | | -002a | |
| temp_oz . . . . . | auto | | | -0028 | |
| icl . . . . . | auto | | | -0026 | |
| ic. . . . . | auto | | | -0024 | |
| zone. . . . . | auto | | | -0022 | |
| wt. . . . . | auto | | | -0020 | |
| swap. . . . . | auto | | | -001e | |
| rv. . . . . | auto | | | -001c | |
| tc. . . . . | auto | | | -001a | |
| prt . . . . . | auto | | | -0018 | |
| tl. . . . . | auto | | | -0014 | |
| t . . . . . | auto | | | -0012 | |
| c . . . . . | auto | | | -0010 | |
| temp_lb . . . . . | auto | | | -000e | |
| pc. . . . . | auto | | | -000c | |
| r . . . . . | auto | | | -000a | |
| ptype . . . . . | auto | | | -0008 | |
| pr. . . . . | auto | | | -0006 | |
| a . . . . . | auto | | | -0002 | |

```
   362 print1()
   363 {
   364         unsigned int c,ic,t,tl,r,icl,tot_oz=0,temp_oz=0,temp_lb=0;
   365         int wt=0,rv=0;
   366         char zone,ptype,a,swap,lc=0,pc=1;
   367         float pr=0,prt=0;
   368         unsigned int tc=0;
```

```
369
370         fprintf(stdprn,"%c",18);
371
372         if((stream3 = fopen("pieces.dat","r")) == NULL)
373         {
374                 printf("FILE ACCESS ERROR: File pieces.dat not found.\n");
375                 exit(1);
376         }
377
378
379         ic = 0;
380         ic1= 0;
381         fseek(stream3,0L,SEEK_SET);
382         do
383         {
384                 rv = fscanf(stream3,"%5d %1d %2d %1d",&c,&zone,&wt,&ptype);
385                 if (rv != 0 && rv != EOF)
386                 {
387                         ic1++;
388
389                         if(ptype == 1 && c != pcs[ic])
390                         {
391                                 ic++;
392                                 pcs[ic] = c;
393                                 rec[ic] = ic1;
394                         }
395                         else if (ptype == 1 && c == pcs[ic])
396                         {
397                                 pcs[ic] = c;
398                                 rec[ic] = ic1;
399                         }
400                         else if (ptype == 0 && c == pcs[ic])
401                         {
402                                 ic--;   /* if changed to priority, back up one */
403                         }
404                 }
405         } while (rv != 0 && rv != EOF);
406
407         t1 = ic;
408         for(r=1;r<=ic;r++)
409         {
410             for(t=1;t<t1;t++)
411             {
412                 if (pcs[t+1] < pcs[t])
413                 {                               /* then swap */
414                         c = pcs[t];
415                         pcs[t] = pcs[t+1];
416                         pcs[t+1] = c;
417                         c = rec[t];
418                         rec[t] = rec[t+1];
419                         rec[t+1] = c;
420                         swap = 1;
421                 }
422             }
423             t1--;
```

```
424             if (swap == 0)
425                 r=ic+1;
426             else swap = 0;
427         }
428
429 /********************** done sorting **********************/
430
431         headerpm(1);
432         rewind(stream3);
433
434
435         for(t=1;t<=ic;t++)
436         {
437             if(pcs[t+1] != pcs[t])
438             {
439              /*   for(r=1;r<=(rec[t]);r++)
440                 {
441                         rv = fscanf(stream3,"%5d %1d %2d %1d\n",&c,&zone,&wt,&ptype);
442                 }  */
443
444                 fseek(stream3,(long)((rec[t]*12)-12),SEEK_SET);
445                 rv = fscanf(stream3,"%5d %1d %2d %1d",&c,&zone,&wt,&ptype);
446
447                 if (zone == 2)
448                         zone = 3;
449
450                 if (wt == 1 || wt == 2)
451                 {
452                         pr = zc[0][2];
453                         pr = pr / 100;
454                 }
455                 else
456                 {
457                         pr = zc[zone-3][wt];
458                         pr = pr / 100;
459
460                 }
461
462                 lc++;
463                 tc++;
464
465                 if(lc >= 45)
466                 {
467                         pc++;
468                         fprintf(stdprn,"____________________________________________________________________________________\n");
469                         fprintf(stdprn,"Page\n");
470                         fprintf(stdprn,"Total: %4d            %6d\n",lc,temp_oz);
471                         fprintf(stdprn,"%c",12);
472                         lc=0;
473                         temp_oz = 0;
474                         headerpm(pc);
475                 }
476                 tot_oz = tot_oz + wt;
477                 temp_oz = temp_oz + wt;
478
```

Line# Source Line Microsoft C Compiler Version 5.10

```
479                 if (zone == 1)
480                 {
481                         uz_tc++;
482                         uz_tp = uz_tp + pr;
483                         uz_tw = uz_tw + wt;
484                 }
485                 if (zone == 3)
486                 {
487                         z3_tc++;
488                         z3_tp = z3_tp + pr;
489                         z3_tw = z3_tw + wt;
490                 }
491                 if (zone == 4)
492                 {
493                         z4_tc++;
494                         z4_tp = z4_tp + pr;
495                         z4_tw = z4_tw + wt;
496                 }
497                 if (zone == 5)
498                 {
499                         z5_tc++;
500                         z5_tp = z5_tp + pr;
501                         z5_tw = z5_tw + wt;
502                 }
503                 if (zone == 6)
504                 {
505                         z6_tc++;
506                         z6_tp = z6_tp + pr;
507                         z6_tw = z6_tw + wt;
508                 }
509                 if (zone == 7)
510                 {
511                         z7_tc++;
512                         z7_tp = z7_tp + pr;
513                         z7_tw = z7_tw + wt;
514                 }
515                 if (zone == 8)
516                 {
517                         z8_tc++;
518                         z8_tp = z8_tp + pr;
519                         z8_tw = z8_tw + wt;
520                 }
521
522                 prt = prt + pr;
523                 if(zone == 1)
524                         zone = 32;
525                 else
526                         zone = zone+48;
527
528                 fprintf(stdprn,"     %5d            %c            %2d            %5.2f          %7.2f\n",c,zone,wt,pr,prt);
529                 fflush(stdprn);
530                 rewind(stream3);
531             }
532         }
533         temp_lb = tot_oz;
```

```
Line#  Source Line                                                                    Microsoft C Compiler Version 5.10

   534          fprintf(stdprn,"_____________________________________________________________________________________\n");
   535          fprintf(stdprn,"\nCUMULATIVE\n");
   536          fprintf(stdprn,"TOTALS              %6d PIECES                          %6d lbs\n",tc,temp_lb);
   537          fprintf(stdprn,"%c",12);
   538          fclose(stream3);
   539          zt_tc = tc;
   540          zt_tp = prt;
   541          pm_summ(temp_lb);
   542          ps_3605(temp_lb);
   543  }

print1  Local Symbols

Name                        Class   Type              Size   Offset  Register

tot_oz. . . . . . . . . . . auto                             -002c
lc. . . . . . . . . . . . . auto                             -002a
temp_oz . . . . . . . . . . auto                             -0028
ic1 . . . . . . . . . . . . auto                             -0026
ic. . . . . . . . . . . . . auto                             -0024
zone. . . . . . . . . . . . auto                             -0022
wt. . . . . . . . . . . . . auto                             -0020
swap. . . . . . . . . . . . auto                             -001e
rv. . . . . . . . . . . . . auto                             -001c
tc. . . . . . . . . . . . . auto                             -001a
prt . . . . . . . . . . . . auto                             -0018
t1. . . . . . . . . . . . . auto                             -0014
t . . . . . . . . . . . . . auto                             -0012
c . . . . . . . . . . . . . auto                             -0010
temp_lb . . . . . . . . . . auto                             -000e
pc. . . . . . . . . . . . . auto                             -000c
r . . . . . . . . . . . . . auto                             -000a
ptype . . . . . . . . . . . auto                             -0008
pr. . . . . . . . . . . . . auto                             -0006
a . . . . . . . . . . . . . auto                             -0002

   544  header1C(pc)
   545  int pc;
   546  {
   547
   548
   549          fprintf(stdprn,"                                MANIFEST LISTING\n");
   550          fprintf(stdprn,"                        SINGLE PIECE FIRST-CLASS MAIL (1-11 OUNCES)          Page %d\n",pc);
   551          fprintf(stdprn,"\n\n");
   552          fprintf(stdprn,"MAILER :   D.M.S.  INC.                                  DATE PREPARED: %s\n",date);
   553          fprintf(stdprn,"       :   INDIANAPOLIS, IN  46202\n");
   554          fprintf(stdprn,"\n");
   555          fprintf(stdprn,"USPS ENTRY POINT:  INDIANAPOLIS, IN  462                  POSTAL PERMIT # 7374\n");
   556          fprintf(stdprn,"_____________________________________________________________________________________\n");
   557          fprintf(stdprn,"\n");
   558          fprintf(stdprn,"   PIECE ID #         WEIGHT NOT              POSTAGE              CUMULATIVE\n");
   559          fprintf(stdprn,"                     EXCEEDING (OZS)                                   TOTAL\n");
   560          fprintf(stdprn,"\n");
   561
```

```
 Line#  Source Line                                                    Microsoft C Compiler Version 5.10

    562  }

header1C  Local Symbols

Name                        Class   Type              Size   Offset  Register

pc. . . . . . . . . . . . . param                            0006

    563
    564  headerpm(pc)
    565  int pc;
    566  {
    567
    568
    569          fprintf(stdprn,"                                MANIFEST LISTING\n");
    570          fprintf(stdprn,"                                 PRIORITY MAIL                          Page %d\n",pc);
    571          fprintf(stdprn,"\n\n");
    572          fprintf(stdprn,"MAILER :   D.M.S. INC.                                  DATE PREPARED: %s\n",date);
    573          fprintf(stdprn,"       :   INDIANAPOLIS, IN  46202\n");
    574          fprintf(stdprn,"\n");
    575          fprintf(stdprn,"USPS ENTRY POINT:  INDIANAPOLIS, IN  462                  POSTAL PERMIT # 7374\n");
    576          fprintf(stdprn,"_______________________________________________________________________________\n");
    577          fprintf(stdprn,"\n");
    578          fprintf(stdprn,"   PIECE ID #       ZONE         WEIGHT NOT         POSTAGE      CUMULATIVE\n");
    579          fprintf(stdprn,"                                EXCEEDING (LBS)                     TOTAL\n");
    580          fprintf(stdprn,"\n");
    581
    582  }

headerpm  Local Symbols

Name                        Class   Type              Size   Offset  Register

pc. . . . . . . . . . . . . param                            0006

    583
    584  ps_3602(tp,tlb,toz,tpost)
    585  unsigned int tp;
    586  int tlb;
    587  int toz;
    588  float tpost;
    589  {
    590
    591          fprintf(stdprn,"%c",15);     /* condensed EPSON */
    592
    593          fprintf(stdprn,"  PS FORM 3602, Apr. 1988\n");
    594          line();
    595          fprintf(stdprn,"      U.S. POSTAL SERVICE                                                          ¦ PERMI
T
         NO.\n");
    596          fprintf(stdprn,"   STATEMENT OF MAILING WITH                                                        ¦\n");
    597          fprintf(stdprn,"        PERMIT IMPRINTS                                                              ¦
              # 7374\n");
    598          fprintf(stdprn,"          (MANIFEST)                                                                ¦\n");
```

```
Line#  Source Line                                                                                    Microsoft C Compiler Version 5.10

   599          line();
   600          fprintf(stdprn,"  POST OFFICE OF MAILING                                  ¦ DATE        ¦ RECEIPT NO.        ¦ MAILING
ST
        ATEMENT SEQUENCE NO.\n");
   601          fprintf(stdprn,"                    INDIANAPOLIS, IN  462                  ¦    %s  ¦                    ¦\n",date);
   602          line();
   603          fprintf(stdprn,"  FIRST-CLASS   (1-11 OUNCES)                              ¦ WEIGHT OF A SINGLE PIECE          ¦ RCA OFFI
CE
        S\n");
   604          fprintf(stdprn,"                                                          ¦        NON IDENTICAL              ¦\n");
   605          line();
   606          fprintf(stdprn,"                                                   ------ TOTAL IN MAILING ------\n");
   607          fprintf(stdprn,"  PIECES                ¦ TOTAL NET WT (POUNDS) ¦ SACKS          ¦ TRAYS             ¦ PALLETS
        ¦ OTHER\n");
   608          fprintf(stdprn,"        %6d           ¦ %5d lbs, %2d oz      ¦                 ¦                   ¦
¦\
        n",tp,tlb,toz);
   609          line();
   610          fprintf(stdprn,"  NAME/ADDRESS of        ¦TELEPHONE NO¦                                POSTAGE COMPUTATION\n");
   611          fprintf(stdprn,"   PERMIT HOLDER         ¦317 634-3625¦_____________________________________________________
__
        _____________________\n");
   612          fprintf(stdprn,"                          ¦___________¦\n");
   613          fprintf(stdprn,"                          ¦           RATE CLASS          ¦        PIECES        ¦        TOT
AL
        POSTAGE\n");
   614          fprintf(stdprn,"    D.M.S. INC.           ¦_____________________________________________________
__
        _____________________\n");
   615          fprintf(stdprn,"    806 N. SENATE AVE     ¦                               ¦                      ¦
        \n");
   616          fprintf(stdprn,"    INDIANAPOLIS, IN  46202 ¦1. FULL FIRST-CLASS POSTAGE ¦        %6d          ¦        $%7.2f
\n
        ",tp,tpost);
   617          fprintf(stdprn,"                          ¦                               ¦                      ¦
        \n");
   618          fprintf(stdprn,"                          ¦                               ¦                      ¦   \n");
   619          line();
   620          fprintf(stdprn,"  2. ADDITIONAL POSTAGE PAYMENT (STATE REASON)                                NO. PCS       RAT
E/
        PC     ¦   POSTAGE $\n");
   621          fprintf(stdprn,"
        ¦\n");
   622          line();
   623          fprintf(stdprn,"  3. TOTAL POSTAGE (1 PLUS 2) WHERE APPLICABLE
¦
        TOTAL POSTAGE $\n");
   624          fprintf(stdprn,"
¦\
        n");
   625          fprintf(stdprn,"
¦
        $%7.2f\n",tpost);
   626          line();
```

```
627         fprintf(stdprn,  The submission of a false, fictitious or fraudulent statement may result in imprisonment of up to 5 yea
rs
        and a fine of up\n");
628         fprintf(stdprn,"  to $10,000. (18 U.S.C. 1001) In addition, a civil penalty of up to $5,000 and an additional assessment
o
        f twice the amount\n");
629         fprintf(stdprn,"                                                    falsely claimed may be imposed. (31 U.S.C. 3802)\n");
630         line();
631         fprintf(stdprn,"     I hereby certify that all information furished on this form is accurate and truthful, and that this
m
        aterial presented\n");
632         fprintf(stdprn,"                                                        qualifies for the rates of postage claimed.\n");
633         line();
634         fprintf(stdprn,"  Signature of Permit Holder of Agent (Both principal and agent are libable of any postage deficiency in
cu
        rred) ¦ Telephone No.\n");
```

```
Line#  Source Line                                                                                                  Microsoft C Compiler Version 5.10

   635         fprintf(stdprn,"
               |\n");
   636         fprintf(stdprn,"
               | 317 634-3625\n");
   637         fprintf(stdprn,"
               |\n");
   638         line();
   639         fprintf(stdprn,"-----------------------------------------------------------------------------------------------------------------
--
        -----------------------\n");
   640         fprintf(stdprn,"  I CERTIFY that this mailing has been inspected to verify that it qualifies for the rate of postage  |
Ro
        und Stamp (Required  |\n");
   641         fprintf(stdprn,"  being paid,and that it is properly prepared (and presorted where required) and that the statement  |
                             |\n");
   642         fprintf(stdprn,"  of mailing has been verified and tha necessary annual fee has been paid.                          |
                             |\n");
   643         fprintf(stdprn,"_____________________________________________________________________________________________________|
                             |\n");
   644         fprintf(stdprn,"                                                                                                    |
                             |\n");
   645         fprintf(stdprn,"                    Signature of Weigher                                  |  Time                   |
                             |\n");
   646         fprintf(stdprn,"                                                                          |                         |
                             |\n");
   647         fprintf(stdprn,"                                                                          |                    A.M. |
                             |\n");
   648         fprintf(stdprn,"                                                                          |                    P.M. |
                             |\n");
   649         fprintf(stdprn,"                                                                          |                         |
                             |\n");
   650         line();
   651         fprintf(stdprn,"\n");
   652         fprintf(stdprn,"  Computerized PS FORM 3602, Apr. 1988\n");
   653         fprintf(stdprn,"                                                                          FINANCIAL DOCUMENT - FORWARD TO
FI
        NANCE OFFICE\n");
   654         fprintf(stdprn,"%c",12);
   655   }

ps_3602  Local Symbols

Name                          Class   Type              Size   Offset  Register

tp. . . . . . . . . . . . . . param                             0006
```

```
tlb . . . . . . . . . . . . . param                    0008
toz . . . . . . . . . . . . . param                    000a
tpost . . . . . . . . . . . . param                    000c

656
657  ps_3605(tlb)
658  int tlb;
659  {
660
661          fprintf(stdprn,"%c",15);     /* condensed EPSON */
662
663          fprintf(stdprn,"  PS FORM 3605, Apr. 1988\n");
```

(44)

```
Line#  Source Line                                                                                    Microsoft C Compiler Version 5.10

   664         line();
   665         fprintf(stdprn,"      U.S. POSTAL SERVICE                                                                                  ¦ PERMI
T
       NO.\n");
   666         fprintf(stdprn,"      STATEMENT OF MAILING                                                                                 ¦\n");
   667         fprintf(stdprn,"        BULK ZONE RATES                                                                                    ¦

            # 7374\n");
   668         fprintf(stdprn,"          (MANIFEST)                                                                                       ¦\n");
   669         line();
   670         fprintf(stdprn,"  POST OFFICE OF MAILING                                  ¦ DATE        ¦ RECEIPT NO.         ¦ MAILING
ST
       ATEMENT SEQUENCE NO.\n");
   671         fprintf(stdprn,"                    INDIANAPOLIS, IN  462                 ¦    %s  ¦                      ¦\n",date);
   672         line();
   673         fprintf(stdprn,"  FIRST-CLASS   PRIORITY MAIL                             ¦ WEIGHT OF A SINGLE PIECE          ¦ RCA OFFI
CE
       S\n");
   674         fprintf(stdprn,"                                                          ¦        NON IDENTICAL              ¦\n");
   675         line();
   676         fprintf(stdprn,"                                                  ------ TOTAL IN MAILING ------\n");
   677         fprintf(stdprn,"  PIECES                ¦ TOTAL NET WT (POUNDS) ¦ SACKS          ¦ TRAYS            ¦ PALLETS

         ¦ OTHER\n");
   678         fprintf(stdprn,"       %6d            ¦ %5d lbs            ¦                  ¦                  ¦                  ¦
\n
       ",zt_tc,tlb);
   679         line();
   680         fprintf(stdprn,"  NAME/ADDRESS of       ¦TELEPHONE NO¦            \n");
   681         fprintf(stdprn,"   PERMIT HOLDER        ¦317 634-3625¦\n");
   682         fprintf(stdprn,"                        ¦____________¦\n");
   683         fprintf(stdprn,"    D.M.S. INC.                      ¦                          POSTAGE COMPUTATION - PRIORITY MAI
L\
       n");
   684         fprintf(stdprn,"    806 N. SENATE AVE                ¦\n");
   685         fprintf(stdprn,"    INDIANAPOLIS, IN  46202          ¦\n");
   686         fprintf(stdprn,"_____________________________________¦_____________________________________________________________
__
       _____________________\n");
   687         fprintf(stdprn,"  ¦         ZONES        ¦              PIECES              ¦              TOTAL POSTAGE PER ZONE

            ¦\n");
   688         line();
   689         fprintf(stdprn,"  ¦ UNZONED (12 oz-2 lb) ¦              %6d                ¦                    %7.2f

         ¦\n",uz_tc,uz_tp);
   690         fprintf(stdprn,"  ¦         1-2-3        ¦              %6d                ¦                    %7.2f

         ¦\n",z3_tc,z3_tp);
   691         fprintf(stdprn,"  ¦           4          ¦              %6d                ¦                    %7.2f

         ¦\n",z4_tc,z4_tp);
   692         fprintf(stdprn,"  ¦           5          ¦              %6d                ¦                    %7.2f

         ¦\n",z5_tc,z5_tp);
   693         fprintf(stdprn,"  ¦           6          ¦              %6d                ¦                    %7.2f

         ¦\n",z6_tc,z6_tp);
```

```
694          fprintf(stdprn,"  |                  |                  %6d                  |                  %7.2f
             |\n",z7_tc,z7_tp);
695          fprintf(stdprn,"  |          8       |                  %6d                  |                  %7.2f
             |\n",z8_tc,z8_tp);
696          line();
697          fprintf(stdprn,"  |        TOTALS    |                  %7d                  |                  %7.2f
             |\n",zt_tc,zt_tp);
698          line();
699          fprintf(stdprn,"  The submission of a false, fictitious or fradulent statement may result in imprisonment of up to 5 yea
rs
             and a fine of up\n");
700          fprintf(stdprn,"  to $10,000. (18 U.S.C. 1001) In addition, a civil penalty of up to $5,000 and an additional assessment
o
```

Microsoft C Compiler Version 5.10

```
LineN  Source Line

       f twice the amount\n");
  701          fprintf(stdprn,"                                                    falsely claimed may be imposed. (31 U.S.C. 3802)\n");
  702          line();
  703          fprintf(stdprn,"     I hereby certify that all information furished on this form is accurate and truthful, and that this
m
       aterial presented\n");
  704          fprintf(stdprn,"                                                    qualifies for the rates of postage claimed.\n");
  705          line();
  706          fprintf(stdprn,"  Signature of Permit Holder or Agent (Both principal and agent are libable of any postage deficiency in
cu
       rred) ¦ Telephone No.\n");
  707          fprintf(stdprn,"

                ¦\n");
  708          fprintf(stdprn,"

                ¦ 317 634-3625\n");
  709          line();
  710          fprintf(stdprn,"  I CERTIFY that this mailing has been inspected to verify that it qualifies for the rate of postage  ¦
Ro
       und Stamp (Required  ¦\n");
  711          fprintf(stdprn,"  being paid,and that it is properly prepared (and presorted where required) and that the statement  ¦

                            ¦\n");
  712          fprintf(stdprn,"  of mailing has been verified and tha necessary annual fee has been paid.                          ¦

                            ¦\n");
  713          fprintf(stdprn,"_____________________________________________________________________________________________¦

                            ¦\n");
  714          fprintf(stdprn,"                                                                                                  ¦

                            ¦\n");
  715          fprintf(stdprn,"                    Signature of Weigher                          ¦  Time                         ¦

                            ¦\n");
  716          fprintf(stdprn,"                                                                  ¦                               ¦

                            ¦\n");
  717          fprintf(stdprn,"                                                                  ¦                     A.M.      ¦

                            ¦\n");
  718          fprintf(stdprn,"                                                                  ¦                     P.M.      ¦

                            ¦\n");
  719          fprintf(stdprn,"                                                                  ¦                               ¦

                            ¦\n");
  720          line();
  721          fprintf(stdprn,"\n");
  722          fprintf(stdprn,"  Computerized PS FORM 3605, Apr. 1988\n");                        FINANCIAL DOCUMENT - FORWARD TO
  723          fprintf(stdprn,"
FI
       NANCE OFFICE\n");
  724          fprintf(stdprn,"%c",12);
  725          fprintf(stdprn,"%c",12);
  726          fflush(stdprn);
  727  }
```

```
ps_3605  Local Symbols

Name                        Class   Type              Size   Offset  Register

tlb . . . . . . . . . . . . param                            0006

    728
    729  line()
    730  {
    731          fprintf(stdprn,"_____________________________________________________________________________________________
__
```

```
Line#  Source Line                                                    Microsoft C Compiler Version 5.10

        ____________________________\n");
   732  }
   733
   734  pm_summ(tbl)
   735  int tbl;
   736  {
   737
   738          fprintf(stdprn,"                          MANIFEST SUMMARY PAGE\n");
   739          fprintf(stdprn,"                               PRIORITY MAIL          \n");
   740          fprintf(stdprn,"\n\n");
   741          fprintf(stdprn,"MAILER :   D.M.S. INC.                                DATE PREPARED: %s\n",date);
   742          fprintf(stdprn,"       :   INDIANAPOLIS,  IN  46202 \n");
   743          fprintf(stdprn,"\n");
   744          fprintf(stdprn,"USPS ENTRY POINT:  INDIANAPOLIS, IN  462                POSTAL PERMIT # 7374\n");
   745          fprintf(stdprn,"_____________________________________________________________________________\n");
   746          fprintf(stdprn,"\n");
   747          fprintf(stdprn,"            ZONE        NUMBER OF PIECES        WEIGHT      POSTAGE\n");
   748          fprintf(stdprn,"_____________________________________________________________________________\n");
   749          fprintf(stdprn,"\n");
   750          fprintf(stdprn,"    UNZONED (12oz-21b)      %5d            %6d      $%7.2f\n",uz_tc,uz_tw,uz_tp);
   751          fprintf(stdprn,"            1-2-3           %5d            %6d      $%7.2f\n",z3_tc,z3_tw,z3_tp);
   752          fprintf(stdprn,"              4             %5d            %6d      $%7.2f\n",z4_tc,z4_tw,z4_tp);
   753          fprintf(stdprn,"              5             %5d            %6d      $%7.2f\n",z5_tc,z5_tw,z5_tp);
   754          fprintf(stdprn,"              6             %5d            %6d      $%7.2f\n",z6_tc,z6_tw,z6_tp);
   755          fprintf(stdprn,"              7             %5d            %6d      $%7.2f\n",z7_tc,z7_tw,z7_tp);
   756          fprintf(stdprn,"              8             %5d            %6d      $%7.2f\n",z8_tc,z8_tw,z8_tp);
   757          fprintf(stdprn,"_____________________________________________________________________________\n");
   758          fprintf(stdprn,"\n");
   759          fprintf(stdprn,"  TOTALS                  %6d         %7d lbs   $%8.2f\n",zt_tc,tbl,zt_tp);
   760          fprintf(stdprn,"%c",12);
   761  }

pm_summ  Local Symbols

Name                        Class   Type              Size   Offset  Register

tbl . . . . . . . . . . . . param                            0006


Global Symbols

Name                        Class   Type              Size   Offset

_iob. . . . . . . . . . . . extern  struct/array      ***    ***
_outtext. . . . . . . . . . extern  far function      ***    ***
_setcolor . . . . . . . . . extern  far function      ***    ***
_settextposition. . . . . . extern  far function      ***    ***
_strdate. . . . . . . . . . extern  far function      ***    ***
atoi. . . . . . . . . . . . extern  far function      ***    ***
cls . . . . . . . . . . . . extern  far function      ***    ***
date. . . . . . . . . . . . common  struct/array        9    ***
exit. . . . . . . . . . . . extern  far function      ***    ***
fclose. . . . . . . . . . . extern  far function      ***    ***
fflush. . . . . . . . . . . extern  far function      ***    ***
```

Global Symbols

| Name | Class | Type | Size | Offset |
|---|---|---|---|---|
| fgetc | extern | far function | *** | *** |
| fopen | extern | far function | *** | *** |
| fprintf | extern | far function | *** | *** |
| fscanf | extern | far function | *** | *** |
| fseek | extern | far function | *** | *** |
| get_cha | extern | far function | *** | *** |
| get_charges | global | far function | *** | 0410 |
| get_zips | global | far function | *** | 0358 |
| header1C | global | far function | *** | 1056 |
| headerpm | global | far function | *** | 1146 |
| inp | extern | far function | *** | *** |
| lbfinal | extern | unsigned int | 2 | *** |
| line | global | far function | *** | 1b36 |
| m | extern | struct/array | 20 | *** |
| outp | extern | far function | *** | *** |
| ozfinal | extern | float | 4 | *** |
| pcs | common | struct/array | 64002 | *** |
| pm_summ | global | far function | *** | 1b50 |
| print | global | far function | *** | 056a |
| printl | global | far function | *** | 0a64 |
| printf | extern | far function | *** | *** |
| priority | global | far function | *** | 0000 |
| ps_3602 | global | far function | *** | 1236 |
| ps_3605 | global | far function | *** | 163c |
| rec | common | struct/array | 64002 | *** |
| rewind | extern | far function | *** | *** |
| sound | global | far function | *** | 02ba |
| stream3 | common | far pointer | 4 | *** |
| tone1 | global | far function | *** | 0268 |
| tone2 | global | far function | *** | 027c |
| tone3 | global | far function | *** | 0290 |
| uz_tc | common | int | 2 | *** |
| uz_tp | common | float | 4 | *** |
| uz_tw | common | int | 2 | *** |
| z3_tc | common | int | 2 | *** |
| z3_tp | common | float | 4 | *** |
| z3_tw | common | int | 2 | *** |
| z4_tc | common | int | 2 | *** |
| z4_tp | common | float | 4 | *** |
| z4_tw | common | int | 2 | *** |
| z5_tc | common | int | 2 | *** |
| z5_tp | common | float | 4 | *** |
| z5_tw | common | int | 2 | *** |
| z6_tc | common | int | 2 | *** |
| z6_tp | common | float | 4 | *** |
| z6_tw | common | int | 2 | *** |
| z7_tc | common | int | 2 | *** |
| z7_tp | common | float | 4 | *** |
| z7_tw | common | int | 2 | *** |
| z8_tc | common | int | 2 | *** |

Global Symbols

| Name | Class | Type | Size | Offset |
|---|---|---|---|---|
| z8_tp . . . . . | common | float | 4 | *** |
| z8_tw . . . . . | common | int | 2 | *** |
| zc. . . . . | common | struct/array | 852 | *** |
| zip . . . . . | common | struct/array | 1000 | *** |
| zone. . . . . | extern | char | 1 | *** |
| zt_tc . . . . . | common | int | 2 | *** |
| zt_tp . . . . . | common | float | 4 | *** |

Code size = 1e30 (7728)
Data size = 3852 (14418)
Bss size  = 0000 (0)

No errors detected

Line# Source Line Microsoft C Compiler Version 5.10

```
 1  /*************************************************************
 2
 3          Source Listing for "THE CHAMP" interfaced to an
 4          electonic meter.  Files Printed below are :
 5
 6                  meter1.c
 7                  gwt.c
 8                  trip.c
 9
10          Written by Christopher A. Baker, M.A.I.L.code Inc.
11
12
13
14                  "THE CHAMP", version 2.1
15                  (Meter interfaced)
16                  (c) M.A.I.L.code Inc., 1989
17                  ALL RIGHTS RESERVED
18
19
20
21                    ******* PROPRIETARY SOFTWARE *******
22
23          THIS SOFTWARE IS THE CONFIDENTIAL PROPERTY OF M.A.I.L.CODE
24          INC.  IT MAY NOT BE DISCLOSED, USED, REPRODUCED, DISTRIBUTED,
25          RECREATED, MODIFIED OR DISPLAYED IN WHOLE, OR IN PART,
26          WITHOUT THE EXPRESS WRITTEN AGREEMENT OF M.A.I.L.CODE INC.
27          MISAPPROPRIATION OF THIS SOFTWARE SHALL BE PROSECUTED TO THE
28          FULLEST EXTENT OF THE LAW.
29
30          (PRINTED 3/20/90 BY CAB)
31
32  ***********************************************************************
    **/
33
34  #include <stdio.h>
35  #include <bios.h>
36  #include <graph.h>
37
38  unsigned int lbs,lbsav,tare,lbfinal;
39  char stable;
40  float lbs1,lbs3;
41  float lbs2,ozfinal;
42  char zone=0,ptype=0;      /* zone and piece type */
43
44
45
46  main()
47  {
```

Line# Source Line Microsoft C Compiler Version 5.10

```
48          unsigned int lb=0,oz1,oz2,koz,kl,ozsav=0;
49          float oz,p,oz3;
50          char bp;
51          char time[20];
52          char c = 1,t;
53
54
55          _setvideomode(_DEFAULTMODE);
56
57          open_com();                    /* open and test communication */
58
59          cursor_off();
60          screen0();
61
62          bp = champ1();                /* test scale and gwt initial weight
63
64          tare = lbs;
```

```
65
66          do
67          {
68                  bp = champ1();                  /* wait will piece removed
69
70                  lbs1 = (tare - lbs)/(float)715;
71
72                  lbs2 = lbs1;
73
74                  lbs1 = lbs1 * 1000;
75                  lbs3 = (unsigned int)lbs1;
76                  if (lbs1-lbs3 > .5)
77                          lbs3++;
78
79                  lbs3 = lbs3/1000;
80                  lbs1 = lbs3;
81
82                  lb = lbs2;
83                  oz = (lbs1 - lb) * 16;
84                  oz2 = oz * 10;
85                  oz3 = oz * 10;
86                  if ((oz3 - oz2) > .5)
87                          oz2++;
88
89                  oz3 = oz2;
90                  oz3 = oz3/10;
91
92                  oz1 = oz;
93                  if((oz - (int)oz) > 0)
94                          oz1++;
95
```

Line# Source Line Microsoft C Compiler Version 5.10

```
 96                  if (oz3 > 15.95 && oz3 <= 16.00)
 97                  {
 98                          oz1=0;
 99                          oz3=0.00;
100                          oz = 0.00;
101                          lb++;
102                  }
103
104                  ozfinal = oz1;                  /* calculate piece weight in
105                  lbfinal = lb;                   /* in this section
106
107                  if(oz1 == 16)
108                  {
109                          lb++;
110                          oz1 = 0;
111                  }
112
113                  if(oz1 > 0 && oz1 <= 11 && lb < 1)
114                  {
115                          trip(oz1);
116                          _settextposition(12,30);
117                          printf("First Class,  %u Ozs          ",oz1);
118                          _settextposition(20,10);
119                          _outtext("
120                  }
121                  else if(lb == 1 || (lb == 2 && oz1 == 0))
122                  {
123                          _settextposition(12,30);
124                          printf("PRIORITY MAIL,  %u Lb %u oz   ",lb,oz1);
125                          trip(lb);
126                  }
127
128                  tare = lbs;
129
130          } while (!kbhit());
131
132  }
```

main Local Symbols

| Name | Class | Type | Size | Offset | Register |
|---|---|---|---|---|---|
| time. . . . . | auto | | | -0032 | |
| lb. . . . . | auto | | | -001e | |
| oz3 . . . . . | auto | | | -001c | |
| oz2 . . . . . | auto | | | -0018 | |
| oz1 . . . . . | auto | | | -0016 | |

Microsoft C Compiler Version 5.10 main Local Symbols

| Name | Class | Type | Size | Offset | Register |
|---|---|---|---|---|---|
| oz. . . . . | auto | | | -0014 | |
| kl. . . . . | auto | | | -0010 | |
| koz . . . . . | auto | | | -000e | |
| t . . . . . | auto | | | -000c | |
| ozsav . . . . . | auto | | | -000a | |
| c . . . . . | auto | | | -0008 | |
| bp. . . . . | auto | | | -0006 | |
| p . . . . . | auto | | | -0004 | |

```
133
134  champ1()
135  {
136          char bp=0;
137
138
139          do
140          {
141                  gwt();
142
143                  _settextposition(23,1);
144
145                  if (stable == 1)
146                  {
147
148                          if ((bp == 0) && (lbs < lbsav-20))
149                          {
150                                  wait_for_piece();
151                                  sound(1200);
152                                  bp = 1;
153                                  lbsav = lbs;
154                          }
155                          else if ((bp == 0) && (lbs > lbsav + 20))
156                          {
157                                  lbsav = lbs;
158                                  tare = lbs;
159                          }
160                          _settextposition(24,70);
161                          _outtext("Stable  ");
162                  }
163                  else
164                  {
165                          bp = 0;
166                          _settextposition(24,70);
```

Microsoft C Compiler Version 5.10

```
Line#  Source Line

   167                         _outtext("Unstable");
   168                 }
   169
   170                 _settextposition(12,35);
   171
   172
   173         } while((bp != 1) && !kbhit());
   174
   175         return(bp);
   176
   177  }
```

champi Local Symbols

| Name | Class | Type | Size | Offset | Register |
|---|---|---|---|---|---|
| bp. . . . . | auto | | | -0002 | |

```
   178
   179
   180  sound(freq)
   181  int freq;
   182  {
   183         unsigned i;
   184         union {
   185                 long divisor;
   186                 unsigned char c[2];
   187               } count;
   188
   189         unsigned char p;
   190
   191
   192         count.divisor = 1193280 / freq;
   193         outp(67,182);
   194         outp(66,count.c[0]);
   195         outp(66,count.c[1]);
   196         p=inp(97);
   197         outp(97,p | 3);
   198
   199         for(i=0;i<19000;++i);
   200
   201         outp(97,p);
   202  }
```

Microsoft C Compiler Version 5.10 sound Local Symbols

| Name | Class | Type | Size | Offset | Register |
|---|---|---|---|---|---|
| i . . . . . | auto | | | -0008 | |
| count . . . . . | auto | | | -0006 | |
| p . . . . . | auto | | | -0002 | |
| freq. . . . . | param | | | 0004 | |

```
   203
   204  wait_for_piece()
   205  {
   206         char c2;
   207
   208         while(_bios_serialcom(_COM_RECEIVE,0,0) != 01);
   209         while(_bios_serialcom(_COM_RECEIVE,0,0) != 'T');
   210         while(_bios_serialcom(_COM_RECEIVE,0,0) != 04);
   211
   212  }
```

wait_for_piece Local Symbols

| Name | Class | Type | Size | Offset | Register |
|---|---|---|---|---|---|
| c2. . . . . | auto | | | -0002 | |

```
213
214  cursor_off()
215  {
216          union REGS inregs;
217
218          inregs.h.ah = 1;
219          inregs.h.ch = 0x0f;
220          inregs.h.cl = 0x00;
221
222          int86(0x10,&inregs,&inregs);
223  }
```

cursor_off Local Symbols

| Name | Class | Type | Size | Offset | Register |
|---|---|---|---|---|---|
| inregs. . . . . | auto | | | -000e | |

```
224
225  screen0()
```

Line# Source Line Microsoft C Compiler Version 5.10

```
226  {
227          unsigned int g;
228          char far *v;
229
230          v = (char far *)0xB8000000;
231
232          for(g=0;g<160;g++)
233          {
234                  *(v+g) = 205;
235                  *(v+320+g) = 205;
236                  *(v+3842+g) = 205;
237                  *(v+3522+g) = 205;
238                  *(v+(++g)) = 15;
239                  *(v+320+g) = 15;
240                  *(v+3842+g) = 15;
241                  *(v+3522+g) = 15;
242
243
244          }
245          for(g=1;g<24;g++)
246          {
247                  *(v+(g*160)) = 186;
248                  *(v+(g*160)+1) = 15;
249                  *(v+(g*160)+158) = 186;
250                  *(v+(g*160)+159) = 15;
251          }
252          *v = 201;
253          *(v+1) = 15;
254          *(v+158) = 187;
255          *(v+159) = 15;
256          *(v+3998) = 188;
257          *(v+3999) = 15;
258          *(v+3840) = 200;
259          *(v+3841) = 15;
260          *(v+320) = 204;
261          *(v+321) = 15;
262          *(v+478) = 185;
263          *(v+479) = 15;
264          *(v+3520) = 204;
265          *(v+3521) = 15;
266          *(v+3678) = 185;
267          *(v+3679) = 15;
```

```
268
269
270         _settextposition(2,3);
271         _outtext("(c) 1989
              ver 2.0");
272  }
```

The Champ - Heavyweight Mail Processor

Microsoft C Compiler Version 5.10 screen0 Local Symbols

| Name | Class | Type | Size | Offset | Register |
|---|---|---|---|---|---|
| g . . . . . | auto | | | -0006 | |
| v . . . . . | auto | | | -0004 | |

Global Symbols

| Name | Class | Type | Size | Offset |
|---|---|---|---|---|
| _bios_serialcom . . . . . | extern | near function | *** | *** |
| _outtext. . . . . | extern | far function | *** | *** |
| _settextposition. . . . . | extern | far function | *** | *** |
| _setvideomode . . . . . | extern | far function | *** | *** |
| champ1. . . . . | global | near function | *** | 02a0 |
| cursor_off. . . . . | global | near function | *** | 0440 |
| gwt . . . . . | extern | near function | *** | *** |
| inp . . . . . | extern | near function | *** | *** |
| int86 . . . . . | extern | near function | *** | *** |
| kbhit . . . . . | extern | near function | *** | *** |
| lbfinal . . . . . | common | unsigned int | 2 | *** |
| lbs . . . . . | common | unsigned int | 2 | *** |
| lbs1. . . . . | common | float | 4 | *** |
| lbs2. . . . . | common | float | 4 | *** |
| lbs3. . . . . | common | float | 4 | *** |
| lbsav . . . . . | common | unsigned int | 2 | *** |
| main. . . . . | global | near function | *** | 0000 |
| open_com. . . . . | extern | near function | *** | *** |
| outp. . . . . | extern | near function | *** | *** |
| ozfinal . . . . . | common | float | 4 | *** |
| printf. . . . . | extern | near function | *** | *** |
| ptype . . . . . | global | char | 1 | 0065 |
| screen0 . . . . . | global | near function | *** | 0468 |
| sound . . . . . | global | near function | *** | 036c |
| stable. . . . . | common | char | 1 | *** |
| tare. . . . . | common | unsigned int | 2 | *** |
| trip. . . . . | extern | near function | *** | *** |
| wait_for_piece. . . . . | global | near function | *** | 03fa |
| zone. . . . . | global | char | 1 | 0064 |

Code size = 05e8 (1512)
Data size = 0101 (257)
Bss size  = 0000 (0)

Line# Source Line

Microsoft C Compiler Version 5.10

```
  1  #include <stdio.h>
  2  #include <bios.h>
  3
  4  char mess[] = "\001P\004";
  5  char setmeter1[] = "\001S053000\004";
  6  char setmeter2[] = "\001S054000\004";
  7  char setmeter3[] = "\001S056000\004";
  8  char setmeter4[] = "\001S058000\004";
  9  char setmeter5[] = "\001S050100\004";
 10  char setmeter6[] = "\001S052100\004";
 11  char setmeter7[] = "\001S054100\004";
```

```
12  char setmeter8[] = "\001S056100\004";
13  char setmeter9[] = "\001S058100\004";
14  char setmeter10[] = "\001S050200\004";
15  char setmeter11[] = "\001S052200\004";
16  char setmeterpm[] = "\001S004200\004";
17
18  char hexd[]="0123456789ABCDEF";
19
20  trip(n)
21  unsigned int n;
22  {
23
24          char c;
25          char buf[26];
26          int t;
27          int sum=0;
28
29          buf[10] = '\0';
30          buf[11] = '\0';
31
32          switch(n)
33          {
34                  case 1: strncpy(buf,setmeter1,9);
35                          break;
36                  case 2: strncpy(buf,setmeter2,9);
37                          break;
38                  case 3: strncpy(buf,setmeter3,9);
39                          break;
40                  case 4: strncpy(buf,setmeter4,9);
41                          break;
42                  case 5: strncpy(buf,setmeter5,9);
43                          break;
44                  case 6: strncpy(buf,setmeter6,9);
45                          break;
46                  case 7: strncpy(buf,setmeter7,9);
47                          break;
48                  case 8: strncpy(buf,setmeter8,9);
49                          break;
50                  case 9: strncpy(buf,setmeter9,9);
51                          break;
52                  case 10: strncpy(buf,setmeter10,9);
53                          break;
54                  case 11: strncpy(buf,setmeter11,9);
55                          break;
56                  case 24: strncpy(buf,setmeterpm,9);
57                          break;
58          }
59
60          for(t=0;t<9;t++)
61          {
62                  _bios_serialcom(_COM_SEND,0,buf[t]);
63                  sum += buf[t];
64          }
65          c = hexd[sum & 0x0f];
66
67          _bios_serialcom(_COM_SEND,0,c);
68
69          c = hexd[(sum>>4) & 0x0f];
70          _bios_serialcom(_COM_SEND,0,c);
71
72
73  }
```

trip Local Symbols

| Name | Class | Type | Size | Offset | Register |
|---|---|---|---|---|---|
| buf . . . . . | auto | | | -0020 | |
| sum . . . . . | auto | | | -0006 | |

```
t . . . . . . . . . . . . . auto                          -0004
c . . . . . . . . . . . . . auto                          -0002
n . . . . . . . . . . . . . param                          0004
```

Global Symbols

| Name | Class | Type | Size | Offset |
|---|---|---|---|---|
| _bios_serialcom . . . . . | extern | near function | *** | *** |
| hexd. . . . . | global | struct/array | 17 | 007c |
| mess. . . . . | global | struct/array | 4 | 0000 |
| setmeter1 . . . . . | global | struct/array | 10 | 0004 |
| setmeter10. . . . . | global | struct/array | 10 | 005e |
| setmeter11. . . . . | global | struct/array | 10 | 0068 |

Microsoft C Compiler Version 5.10

Global Symbols

| Name | Class | Type | Size | Offset |
|---|---|---|---|---|
| setmeter2 . . . . . | global | struct/array | 10 | 000e |
| setmeter3 . . . . . | global | struct/array | 10 | 0018 |
| setmeter4 . . . . . | global | struct/array | 10 | 0022 |
| setmeter5 . . . . . | global | struct/array | 10 | 002c |
| setmeter6 . . . . . | global | struct/array | 10 | 0036 |
| setmeter7 . . . . . | global | struct/array | 10 | 0040 |
| setmeter8 . . . . . | global | struct/array | 10 | 004a |
| setmeter9 . . . . . | global | struct/array | 10 | 0054 |
| setmeterpm. . . . . | global | struct/array | 10 | 0072 |
| strncpy . . . . . | extern | near function | *** | *** |
| trip. . . . . | global | near function | *** | 0000 |

```
Code size = 0150 (336)
Data size = 008d (141)
Bss size  = 0000 (0)
```

No errors detected

Line# Source Line Microsoft C Compiler Version 5.10

```
 1  #include <stdio.h>
 2  #include <bios.h>
 3  #include <stdlib.h>
 4  #include <graph.h>
 5
 6  #define COM_NUM 1       /* com2 */
 7
 8  extern unsigned int lbs,tare,lbsav;
 9  extern char stable;
10  char far *buffer[10];
11  unsigned int com_err1;
12  float total_post_1c,total_post_pm;
13  char scn_buffer[3000];
14  char far *v;
15
16  gwt()
17  {
18
19          unsigned int l,lbh,lbl,t=0,r=0;
20          unsigned int ls[300];
21          double lbt=0;
22
23          get_weight();
24          lbl = lbs;
25          lbh = lbs;
```

```
26
27          if (!kbhit())
28          {
29                  for(l=0;l<2;l++)
30                  {
31                                  get_weight();
32
33                                  if (lbs < lbl)
34                                          lbl = lbs;
35                                  else
36                                          ls[t++] = lbs;
37
38                                  if (lbs > lbh)
39                                          lbh = lbs;
40                                  else
41                                          ls[t++] = lbs;
42                                  if ((lbh-lbl) > 4)
43                                          l = 5;
44                  }
45
46                  if ((lbh - lbl) <= 4)
47                  {
48                          stable = 1;
49                          for(r=0;r<t;r++)
50                                  lbt += ls[r];
51
52                          lbs = lbt/t;
53
54                  }
55                  else
56                          stable = 0;
57          }
58          else
59                  stable = 0;
60  }
```

gwt Local Symbols

| Name | Class | Type | Size | Offset | Register |
|---|---|---|---|---|---|
| ls. . . . . | auto | | | -026a | |
| l . . . . . | auto | | | -0012 | |
| lbl . . . . . | auto | | | -0010 | |
| lbh . . . . . | auto | | | -000e | |
| t . . . . . | auto | | | -000c | |
| r . . . . . | auto | | | -000a | |
| lbt . . . . . | auto | | | -0008 | |

```
61
62
63  get_weight()
64  {
65
66  /* This routine requests the scale's weight with any character */
67  /* and returns it in a count    */
68
69
70          unsigned char temp,com_err=0;
71          unsigned int com_char[6],c=0,i,j,j1;
72          unsigned int c1,c2;
73
74          for(j1=0;j1<4;j1++)
75                  for(j=0;j<21000;j++);
76
77      /*    for(j=0;j<32000;j++);  */
78
79          do
80          {
81                  c1 = _bios_serialcom(_COM_STATUS,COM_NUM,0);
82                  if((c1 & 0x0100) == 0x0100)
```

```
Line#  Source Line                                   Microsoft C Compiler Version 5.10

    83                          c2 = _bios_serialcom(_COM_RECEIVE,COM_NUM,0);
    84
    85          } while ((c1 & 0x0100) == 0x0100);
    86
    87          com_char[1] = 0;
    88          com_char[2] = 0;
    89
    90          do
    91          {
    92                  temp = _bios_serialcom(_COM_SEND,COM_NUM,87);     /* ' ' :
    93
    94      while(((c2 = _bios_serialcom(_COM_STATUS,COM_NUM,0)) & 0x0100) ==
        0x100);
    95
    96      com_char[1] = _bios_serialcom(_COM_RECEIVE,COM_NUM,0);
    97
    98      while(((c2 = _bios_serialcom(_COM_STATUS,COM_NUM,0)) & 0x0100) ==
        0x100);
    99
   100      com_char[2] = _bios_serialcom(_COM_RECEIVE,COM_NUM,0);
   101
   102
   103      if(((com_char[1] & 0xF000) > 0) || ((com_char[2] & 0xF000) > 0))
   104                  {
   105                          com_problem();
   106                          com_err = 1;
   107                          com_err1 = 2;
   108                  }
   109                  else
   110                          com_err = 0;
   111
   112                  if(com_err1 > 1)
   113                  {
   114                          restore_from_error();
   115                  }
   116
   117          } while (com_err == 1);
   118
   119          lbs = (com_char[1]*256) + com_char[2];
   120
   121          if (lbs < 32768)
   122                  lbs = 32678 - lbs;
   123
   124          if(com_err1 > 0)
   125          {
   126                  tare = lbs;
   127                  lbsav = lbs;
   128                  com_err1--;
   129          }
   130
   131  }
```

get_weight  Local Symbols

| Name | Class | Type | Size | Offset | Register |
|---|---|---|---|---|---|
| com_char. . . . . | auto | | | -001c | |
| j1. . . . . | auto | | | -0010 | |
| j . . . . . | auto | | | -000e | |
| i . . . . . | auto | | | -000c | |
| com_err. . . . . | auto | | | -000a | |
| temp. . . . . | auto | | | -0008 | |
| c2. . . . . | auto | | | -0006 | |
| c1. . . . . | auto | | | -0004 | |
| c . . . . . | auto | | | -0002 | |

```
132  com_problem(r)
133  unsigned int r;
134  {
135          char c;
136
137          save_for_error();
138          _setcolor(15);
139          _settextposition(17,18);
140          _outtext("ZDDDDDDDDDDDDDDDDDDDDDDDDDDDDDDDDDDDDDDD?");
141          _settextposition(18,18);
142            printf("3          SCALE ERROR ! (%4x)          3",r);
143          _settextposition(19,18);
144          _outtext("3     Press any key to continue ...     3");
145          _settextposition(20,18);
146          _outtext("@DDDDDDDDDDDDDDDDDDDDDDDDDDDDDDDDDDDDDDDY");
147          c = getch();
148          _setcolor(7);
149  }
```

com_problem Local Symbols

| Name | Class | Type | Size | Offset | Register |
|---|---|---|---|---|---|
| c . . . . . | auto | | | -0002 | |
| r . . . . . | param | | | 0004 | |

```
150  save_for_error()
151  {
152          int t,t1;
153
154          for(t=15;t<22;t++)
155          {
156                  for(t1=18;t1<126;t1+=2)
157                  {
158                          scn_buffer[((t-15)*160)+t1] = *(v+(t*160)+t1);
159                          scn_buffer[((t-15)*160)+t1+1] = *(v+(t*160)+t1+1)
160                          *(v+(t*160)+t1) = 0;
161                          *(v+(t*160)+t1+1) = 7;
162                  }
163          }
164  }
```

save_for_error Local Symbols

| Name | Class | Type | Size | Offset | Register |
|---|---|---|---|---|---|
| t1. . . . . | auto | | | -0004 | |
| t . . . . . | auto | | | -0002 | |

```
165
166  restore_from_error()
167  {
168          int t,t1;
169
170          for(t=15;t<22;t++)
171          {
172                  for(t1=18;t1<126;t1+=2)
173                  {
174                          *(v+(t*160)+t1) = scn_buffer[((t-15)*160)+t1];
175                          *(v+(t*160)+t1+1) = scn_buffer[((t-15)*160)+t1+1]
176
177                  }
178
179          }
180  }
```

restore_from_error Local Symbols

| Name | Class | Type | Size | Offset | Register |
|---|---|---|---|---|---|
| t1. . . . . | auto | | | -0004 | |
| t . . . . . | auto | | | -0002 | |

Microsoft C Compiler Version 5.10

Global Symbols

| Name | Class | Type | Size | Offset |
|---|---|---|---|---|
| _bios_serialcom . . . . . | extern | near function | *** | *** |
| _outtext. . . . . | extern | far function | *** | *** |
| _setcolor . . . . . | extern | far function | *** | *** |
| _settextposition. . . . . | extern | far function | *** | *** |
| buffer. . . . . | common | struct/array | 40 | *** |
| com_err1. . . . . | common | unsigned int | 2 | *** |
| com_problem . . . . . | global | near function | *** | 024e |
| get_weight. . . . . | global | near function | *** | 00fc |
| getch . . . . . | extern | near function | *** | *** |
| gwt . . . . . | global | near function | *** | 0000 |
| kbhit . . . . . | extern | near function | *** | *** |
| lbs . . . . . | extern | unsigned int | 2 | *** |
| lbsav . . . . . | extern | unsigned int | 2 | *** |
| printf. . . . . | extern | near function | *** | *** |
| restore_from_error. . . . | global | near function | *** | 035c |
| save_for_error. . . . . | global | near function | *** | 02ea |
| scn_buffer. . . . . | common | struct/array | 3000 | *** |
| stable. . . . . | extern | char | 1 | *** |
| tare. . . . . | extern | unsigned int | 2 | *** |
| total_post_1c . . . . . | common | float | 4 | *** |
| total_post_pm . . . . . | common | float | 4 | *** |
| v . . . . . | common | far pointer | 4 | *** |

Code size = 03be (958)
Data size = 00a7 (167)
Bss size = 0000 (0)

No errors detected bytes are received or a timeout occurs. Subsequently, at step 688, computer 512 checks to determine whether a timeout occurred at step 686. If a timeout did occur, program execution continues at step 692 where the computer displays the message "scale error" on display 516 and the communications port is re-initialized at step 694. In addition, the flag indicating that a scale error or timeout occurred is reset at step 696 before program execution returns to the calling routine. If at step 688 it is determined that a timeout did not occur at step 686, then program execution continues at step 690 where computer 512 will calculate the scale count in ounces by converting the two byte value received in step 686 into ounces. Such a conversion is well-known in the art and need not be discussed here.

Attached to the end of the description of the preferred embodiment are further additional computer software listings for the programs executed by the computer 512 of the alternate embodiment according to the present invention. The programs are in the "C" language and correspond to the programs described in the flowcharts of FIGS. 6–11. The software listings for the embodiment of FIG. 5 are dated either Mar. 18, 1990 or Mar. 6, 1990. The flowchart of FIG. 6 is corresponds with the main control loop designated MAIN in the program listing. The flowchart of FIG. 7 corresponds to the routine named CHAMP1. The flowchart of FIG. 8 corresponds to the routine named TRIP in the software listing. The flowchart of FIG. 9 corresponds to the subroutine named WEIGHT_4 PIECE. The flowchart of FIG. 10 corresponds to the routine named GWT of the software listing. The flowchart of FIG. 11 corresponds to the routine labelled GET_WEIGHT.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. While the term "mail pieces" is used, it is to be understood that such should also be interpreted to cover parcels as well.

What is claimed is:

1. An apparatus for weighing mail pieces and producing a weight manifest, said apparatus comprising:

means for weighing a plurality of mail pieces at one time;

means for detecting in connection with said means for weighing an initial stabilized weight state, a first subsequent stabilized weight state in response to a change in the number of mail pieces, and a second subsequent stabilized weight state in response to a further change in the number of mail pieces;

first difference means for calculating in response to the occurrence of said first subsequent stabilized weight state a first weight value equal to the absolute difference between said initial and said first subsequent stabilized weight state;

second difference means for calculating in response to the occurrence of said second subsequent stabilized weight state a second weight value equal to the absolute difference between said first subsequent stabilized weight state and said second subsequent stabilized weight state; and means for producing a manifest including said first and second weight values.

2. The apparatus for weighing mail pieces of claim 1 wherein said means for producing a manifest includes means for generating and printing on said manifest a unique serial number for said first and second weight values and a postage cost corresponding to said first and second weight values.

3. The apparatus for weighing mail pieces of claim 2 including means for inputting a mail classification code when said first or second weight values are in excess of a predetermined weight, and printing means for printing said unique serial number and said mail classification code on a stick-on label.

4. The apparatus for weighing mail pieces of claim 2 including means for inputting an optional mail classification code for said first or second difference weights if said first or second weight values are in excess of a predetermined weight, and printing means for printing said unique serial number and said optional mail classification code on said mail piece.

5. The apparatus for weighing mail pieces of claim 2 wherein said means for weighing is a load cell.

6. The apparatus for weighing mail pieces of claim 5 wherein said means for detecting, said first difference means, and said second difference means are components of a computer system having RAM, ROM, A/D converter, a printer, a display, and an operator input device.

7. An apparatus for producing a mail piece weight manifest comprising:

a container containing said mail pieces;

means from which said container containing mail pieces is readily removeable, for producing a weight signal corresponding to the weight of said container containing mail pieces;

means for producing piece weight connected to said means for producing a weight signal, said means for producing piece weight responding to said weight signal when said weight signal changes from an initial stable state to a successive stable state and producing a weight difference signal at an output in response to the occurrence of each successive stable state; and means responsive to said weight difference signal for producing a manifest, said means responsive to said weight difference signal responding to said weight difference signal and creating a manifest documenting the magnitude of each weight difference signal produced by said means for producing a piece weight.

8. The apparatus for producing a weight manifest of claim 7 wherein said means for producing a weight signal is a load cell.

9. The apparatus for producing a weight manifest of claim 8 wherein said means for producing piece weight and said means responsive to said weight difference signal are portions of a computer system including RAM, ROM, a CRT display, an operator interface, and a printer.

10. An apparatus for weighing mail pieces and producing a weight manifest including mail piece weight and corresponding postage charges, said apparatus comprising:

means for supporting a plurality of mail pieces;

a strain gage attached to said means for supporting, said strain gage producing at an output a weight signal corresponding to forces acting on said strain gage;

digital analysis means connected to said strain gage output, said digital analysis means including means for monitoring said weight signal and means for detecting a first and subsequent stabilized weight states, said means for detecting producing at an output a weight difference signal and corresponding postage cost signal corresponding to the absolute difference between each subsequent stabilized weight state detected by said means for detecting and an immediately preceding stabilized weight state wherein each subsequent stabilized weight state corresponds to a change in the number of mail pieces situated on said means for supporting; and printer means responsive to said weight difference signal and said postage cost signal for printing a manifest entry including said weight difference entry, a serial number and a postage cost entry.

11. An apparatus for weighing mail pieces and producing a weight manifest including mail piece weight, said apparatus comprising:

a bin containing mail pieces;

weighing means attached to said bin and producing at an output a weight signal proportional to the weight of said bin containing mail pieces;

stable weight detecting means responsive to said weight signal and producing at an output in response to a change in the number of mail pieces contained in said bin a piece weight signal corresponding to the weight difference calculated between a present stabilized weight signal and an immediately preceding stabilized weight signal; and a printer responsive to said piece weight signal, said printer printing a mail piece weight corresponding to each piece weight signal as received thereby producing a weight manifest.

12. An apparatus for preparing an object weight manifest comprising:

weighing means for weighing a bin containing objects, said weighing means producing at an output an analog weight signal proportional to the weight of said bin including objects contained within said bin;

digital analysis means including an A/D converter means for converting said analog weight signal into digital values, memory means for storing said digital values, said digital analysis means producing at an output a difference signal for each occurrence of a subsequent stable weight signal, said difference signal corresponding to the absolute difference between a present stable weight signal and an immediately preceding stable weight signal wherein said difference signal corresponds to a change in the number of mail objects in said bin; and first printer means connected to said digital analysis means and responsive to said difference signal for printing a weight manifest.

13. The apparatus of claim 12 wherein said digital analysis means includes means for inputting a zone code, said digital analysis means requesting operator input by way of a visual signal produced when said weight signal changes by more than a predetermined limit.

14. The apparatus of claim 12 wherein said digital analysis means is a digital computer including an A/D converter, RAM, ROM, and a printer interface.

15. The apparatus of claim 12 including second printer means responsive to said print signal for printing a classification code and a serial number on a label.

16. The apparatus of claim 12 including second printer means responsive to said print signal for printing a classification code and a serial number on objects removed from said bin.

17. The apparatus of claim 14, 15, or 16 wherein said weighing means is a load cell having said bin attached thereto.

18. The apparatus of claim 17 wherein said bin is removably attached to said load cell.

19. A method for producing a weight manifest comprising the steps of:

situating all objects to be weighed into a weighing bin connected to a weighing device, said weighing device producing at an output a signal proportional to the weight of the bin including the objects therein;

monitoring said signal until said signal stabilizes;

removing an object from within the bin;

monitoring said signal and detecting removal of a first one of said objects from said bin;

determining the weight of the removed object and correlating it with a unique serial number;

monitoring said signal and detecting removal of a second one of said objects in said bin;

determining the weight of the second removed object and correlating it with a second unique serial number; and printing a manifest entry including the determined weights and correlated unique serial numbers.

20. The method of claim 19 including after each determining step, the step of printing said serial number on a label, and affixing said label to said removed object.

21. The method of claim 19 including the step of converting said signal into binary data with an A/D converter and converting said binary data into a weight value and printing said weight value and a corresponding postage cost for said weight value on a printer.

22. An apparatus for weighing mail pieces and determining postage cost for each mail piece comprising:

means for weighing a plurality of mail pieces at one time;

means for automatically detecting in connection with said means for weighing an initial stabilized weight state, a first subsequent stabilized weight state in response to a change in the number of mail pieces, and a second subsequent stabilized weight state in response to a further change in the number of mail pieces;

first difference means for calculating in response to the occurrence of said first subsequent stabilized weight state a first weight value equal to the absolute difference between said initial and said first subsequent stabilized weight state and printing a postage label in response thereto; and second difference means for calculating in response to the occurrence of said second subsequent stabilized weight state a second weight value equal to the absolute difference between said first and said second subsequent stabilized weight state, said second difference means including means for determining postage cost in response to calculation of said second weight value and means for printing a postage label including a postage cost in response to determination of said postage cost.

23. The apparatus for weighing mail pieces of claim 22 including means for inputting an optional mail classification code for said first or second difference weights if said first or second difference weights are in excess of a predetermined weight.

24. The apparatus for weighing mail pieces of claim 22 wherein said means for weighing is a load cell.

25. The apparatus for weighing mail pieces of claim 24 wherein said means for detecting, said first difference means, and said second difference means are components of a computer system having RAM, ROM, A/D converter, a printer, a display, and an operator input device.

26. The apparatus for weighing mail pieces of claim 25 including means for changing postage rates for producing said postage label when said first or second difference weights are in excess of a predetermined weight.

27. An apparatus for weighing and determining postage for mail pieces comprising:

a container containing mail pieces;

means from which said container containing mail pieces is readily removeable, for continuously producing a weight signal corresponding to the weight of said container containing mail pieces;

means for automatically producing piece weight connected to said means for producing a weight signal, said means for automatically producing piece weight responding to said weight signal when said weight signal changes from an initial stable signal level to a successive stable signal level and producing a weight difference signal at an output in response to the occurrence of each successive stable signal level; and means responsive to said weight difference signal for determining a postage cost and producing a corresponding postage cost signal; and means for producing a mailing label including postage cost in response to said postage cost signal.

28. The apparatus of claim 27 wherein said means for producing a weight signal is a load cell.

29. The apparatus of claim 28 wherein said means for producing piece weight and said means responsive to said weight difference signal are portions of a computer system including RAM, ROM, a CRT display, an operator interface, and a printer.

30. An apparatus for weighing mail pieces and printing on each mail piece a postage cost for said mail piece, said apparatus comprising:

means for supporting a plurality of mail pieces;

a strain gage attached to said means for supporting, said strain gage producing at an output a weight signal corresponding to forces acting on said strain gage;

digital analysis means connected to said strain gage output, said digital analysis means including means for monitoring said weight signal and means for automatically detecting a first and subsequent stabilized weight states, said means for detecting producing at an output a series of postage cost signals, each postage cost signal corresponding to the absolute difference between each subsequent stabilized weight state detected by said means for detecting and an immediately preceding stabilized weight state and wherein each subsequent stabilized weight state corresponds to a change in the number of mail pieces situated on said means for supporting; and postage cost means responsive to said postage cost signal for producing a postage label.

31. An apparatus for weighing mail pieces and producing a postage label for each of said mail pieces including appropriate postage charges, said apparatus comprising:

a bin containing mail pieces;

weighing means attached to said bin and producing at an output a weight signal proportional to the weight of said bin containing mail pieces;

stable weight detecting means responsive to said weight signal and automatically producing at an output in response to a change in the number of mail pieces contained in said bin a piece weight signal corresponding to the weight difference between a present stabilized weight signal and an immediately preceding stabilized weight signal; and a printer responsive to said piece weight signal, said printer printing a postage label including postage costs corresponding to each piece weight signal received by said printer.

32. An apparatus for automatically producing postage cost labels for objects of assorted weights comprising:

weighing means for weighing a bin containing said objects, said weighing means producing at an output an analog weight signal proportional to the weight of said bin including said objects contained within said bin;

digital analysis means including an A/D converter means for converting said weight signal into digital values, memory means for storing said digital values, said digital analysis means producing at an output a difference signal for each occurrence of a subsequent stable weight signal, said difference signal corresponding to the absolute difference between a present stable weight signal and an immediately preceding stable weight signal wherein said difference signal corresponds to a change in weight of said bin in response to a change in the number of mail objects contained in said bin; and first printer means connected to said digital analysis means and responsive to said difference signal for printing a postage cost label.

33. The apparatus of claim 32 wherein said digital analysis means is a digital computer including an A/D converter, RAM, ROM, and a printer interface.

34. The apparatus of claim 33 wherein said weighing means is a load cell having said bin attached thereto.

35. The apparatus of claim 34 wherein said bin is removably attached to said load cell.

36. A method for weighing objects and producing a postage label for each of said objects comprising the steps of:

situating said objects to be weighed into a weighing bin connected to a weighing device, said weighing device producing at an output a signal proportional to the weight of the bin including the weight of said objects;

monitoring said signal until said signal stabilizes and storing said signal as an initial stable signal state;

removing a first object from within said bin;

monitoring said signal and automatically detecting removal of said first object from said bin by monitoring said signal and detecting a first stable signal state;

automatically determining the weight of said first object and printing a postage label including postage cost for said first object based upon the difference between said initial stable signal state and said first stable signal state;

removing a second object from said bin;

monitoring said signal and detecting removal of a second object from within said bin by monitoring said signal and detecting a second stable signal state; and automatically determining the weight of said second object by determining the difference between first stable signal state and said second stable signal state and printing a postage label including postage cost for said second object based upon its weight.

37. The method of claim 36 including after each automatically determining step, the step of affixing said postage label to said removed object.

* * * * *